US010661430B2

(12) United States Patent
Blake

(10) Patent No.: US 10,661,430 B2
(45) **Date of Patent: *May 26, 2020**

(54) TOOL TRAY SYSTEMS AND DEVICES

(71) Applicant: Invoke 3D, LLC, Mooresville, IN (US)

(72) Inventor: Dewayne Eugene Blake, Mooresville, IN (US)

(73) Assignee: Invoke 3D, LLC, Mooresville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/181,584

(22) Filed: Nov. 6, 2018

(65) Prior Publication Data

US 2019/0337144 A1 Nov. 7, 2019

Related U.S. Application Data

(63) Continuation of application No. 15/728,576, filed on Oct. 10, 2017, now Pat. No. 10,118,288, which is a continuation of application No. 14/839,559, filed on Aug. 28, 2015, now Pat. No. 9,782,891, which is a continuation-in-part of application No. 14/329,937, filed on Jul. 12, 2014, now Pat. No. 9,403,271.

(60) Provisional application No. 62/043,000, filed on Aug. 28, 2014, provisional application No. 62/115,797, filed on Feb. 13, 2015, provisional application No. 61/845,441, filed on Jul. 12, 2013.

(51) Int. Cl.
*B25H 3/06* (2006.01)

(52) U.S. Cl.
CPC ..... *B25H 3/06* (2013.01)

(58) Field of Classification Search
CPC ... B25H 3/00; B25H 3/04; B25H 3/06; B25H 5/00; E06C 7/00; E06C 7/14; E06C 7/16; E06C 7/165
See application file for complete search history.

(56) References Cited

U.S. PATENT DOCUMENTS

| | | | | |
|---|---|---|---|---|
| 5,782,314 | A * | 7/1998 | Zeitler | E06C 7/14 182/129 |
| 6,076,937 | A * | 6/2000 | Wood | B25H 3/06 362/154 |
| 6,148,958 | A * | 11/2000 | Ahl | E06C 7/14 182/121 |
| 6,361,003 | B1 * | 3/2002 | Keoun | B66F 11/044 248/213.2 |
| 8,684,166 | B2 * | 4/2014 | Huff | B65G 47/52 198/463.3 |
| 9,440,831 | B2 * | 9/2016 | Goodheart | E04G 7/16 |
| 2002/0023994 | A1 * | 2/2002 | De Shann | A47C 7/70 248/346.01 |
| 2007/0089931 | A1 * | 4/2007 | Hunt | A01M 31/02 182/129 |

(Continued)

*Primary Examiner* — Bryon P Gehman
(74) *Attorney, Agent, or Firm* — Reichel Stohry Dean LLP; Mark C. Reichel; Natalie J. Dean

(57) ABSTRACT

Novel tool tray systems and devices. In at least one exemplary embodiment of a tray of the present disclosure, the tray comprises an interior tray section configured to receive one or more items, the interior tray at least partially surrounded by at least one sidewall having a height, a first ramp portion in communication with the interior tray section, the first ramp portion defining a sloping surface that extends from the interior tray section to a top of the at least one sidewall, wherein the at least one tray is configured to be secured to an inner lip of an aerial bucket liner.

20 Claims, 19 Drawing Sheets

(56) References Cited

U.S. PATENT DOCUMENTS

| | | | | |
|---|---|---|---|---|
| 2008/0060959 | A1* | 3/2008 | Hendrix | B25H 3/06 206/372 |
| 2012/0298539 | A1* | 11/2012 | Purnell, Jr. | B25H 3/02 206/372 |

* cited by examiner

TOOL TRAY SYSTEMS AND DEVICES

PRIORITY

The present application is related to, claims the priority benefit of, and is a U.S. continuation patent application of, U.S. Nonprovisional patent application Ser. No. 15/728,576, filed Oct. 10, 2017 and issued as U.S. Pat. No. 10,118,288 on Nov. 6, 2018, which is related to, claims the priority benefit of, and is a U.S. continuation patent application of, U.S. Nonprovisional patent application Ser. No. 14/839,559, filed Aug. 28, 2015 and issued as U.S. Pat. No. 9,782,891 on Oct. 10, 2017, which a) is related to, claims the priority of, and is a continuation-in-part of, U.S. Nonprovisional patent application Ser. No. 14/329,937, filed Jul. 12, 2014, which is related to, and claims the priority benefit of, U.S. Provisional Patent Application Ser. No. 61/845,441, filed Jul. 12, 2013; b) is related to, and claims the priority benefit of, U.S. Provisional Patent Application Ser. No. 62/043,000, filed Aug. 28, 2014; and c) is related to, and claims the priority benefit of, U.S. Provisional Patent Application Ser. No. 62/115,797, filed Feb. 13, 2015. The contents of each of the aforementioned applications are hereby incorporated by reference in their entirety into the present disclosure.

BACKGROUND

Utility linemen are often required to work in elevated workstations such as utility trucks with aerial buckets. These aerial buckets are typically located at the end of an extendable hydraulically driven arm that is attached to a truck or other vehicle and are capable of lifting one or more linemen to elevated positions above the ground.

Once in position, the linemen is often required to perform repairs or assemblies utilizing many tools and small parts such as washers, nuts, and bolts. While performing the repairs and assemblies, the linemen normally required to wear leather gloves and may sometimes be required to wear thick electrically insulated gloves. These thick gloves make it significantly more difficult to grasp and manipulate small objects.

An aerial bucket typically consists of an open box configuration with a lip surface that extends around the upper open portion of the box. When removing and installing parts for their work, linemen are frequently handling small tools and hardware and for convenience lineman may occasionally place these items onto the lip of the bucket. Tools and hardware stored on the lip of the bucket have a high probability of falling off the lip resulting in lost hardware and productivity. The use of gloves when manipulating tools and hardware stored on the lip of the bucket further increases the probability that an item will fall off the bucket lip.

To solve this problem, there are several related inventions known in the art. For example, hardware storage devices such as bag type apparatuses are configured with one or more grommets capable of receiving hooks that are attached to the lip of the aerial bucket. These bag devices contain a plurality of pockets for storing and organizing tools and hardware. However, when using gloves linemen can have great difficulty retrieving and manipulating specific items in the pockets of these bag storage devices.

Therefore, a need exists for a new storage and hardware staging tray that is capable of attaching to the lip of aerial buckets and other raised workstations, and is able to facilitate the manipulation and organization of small pieces of hardware by gloved hands.

BRIEF SUMMARY

The present disclosure relates to novel tool tray apparatus embodiments for use with an elevated workstation such as an aerial bucket commonly found on utility trucks. In at least one embodiment, the present disclosure relates to a tool tray apparatus having an interior sidewall surface, one or more means for attaching the apparatus to an elevated workstation, and optionally, one or more means for facilitating the storage and manipulation of small tools and hardware by gloved hands.

In various embodiments, the present disclosure provides a novel tool tray apparatus having the capability of attaching to various elevated work stations including aerial buckets. The present disclosure comprises an interior tray surface bordered by four sidewalls and one or more means for attaching the device to an elevated workstation, which may comprise one or more saddles which are capable of engaging with a means for securing the device to the lip of an aerial bucket or other raised workstation. In some embodiments, the device further comprises one or more ramps capable of providing a sloped transitional surface from the base of the interior surface to the top of one or more sidewalls. In other embodiments, the device also comprises a means for storing and organizing hardware such as nuts and washers through a removable, vertically oriented dowel and stanchion. In these embodiments, the inclusion of a tray ramp, dowel, and stanchion help facilitate the manipulation and storage of hardware and tools by gloved hands.

In at least one exemplary embodiment of a tray of the present disclosure, the tray comprises an interior tray section configured to receive one or more items, the interior tray at least partially surrounded by at least one sidewall having a height, at least one attachment saddle coupled to the interior tray section, the at least one attachment saddle configured to receive a portion of an aerial bucket hook, and a first ramp portion in communication with the interior tray section, the first ramp portion defining a sloping surface that extends from the interior tray section to a top of the at least one sidewall. In another embodiment, one or more drain holes are defined within the interior tray section. In yet another embodiment, the tray further comprises a stanchion formed in or coupled to interior tray section, the stanchion configured to engage a removable dowel. In an additional embodiment, the tray further comprises the removable dowel, the removable dowel configured to reversibly engage the stanchion.

In at least one exemplary embodiment of a tray of the present disclosure, the tray defines at least one mounting slot therein, the at least one mounting slot configured to receive part of a self-locking cable tie. In an additional embodiment, the tray is configured for placement upon a lip of an aerial bucket, and wherein the tray is further configured to be retained upon the aerial bucket using the aerial bucket hook. In yet an additional embodiment, the tray further comprises a second ramp portion in communication with the interior tray section, the second ramp portion defining a second sloping surface that extends from the interior tray section to the top of the at least one sidewall. In another embodiment, the second ramp is located opposite the first ramp. In yet another embodiment, the second ramp is located adjacent to the first ramp.

In at least one exemplary embodiment of a tray of the present disclosure, the tray is formed of a non-conductive material. In another embodiment, the tray (or the one or more sidewalls of the tray) has an outer shape selected from the group consisting of a rectangular shape, a square shape, and a round shape.

In at least one exemplary embodiment of a system of the present disclosure, the system comprises a first tray, comprising an interior tray section configured to receive one or more items, the interior tray at least partially surrounded by at least one sidewall having a height, and a first ramp portion in communication with the interior tray section, the first ramp portion defining a sloping surface that extends from the interior tray section to a top of the at least one sidewall; and a tool board, wherein the first tray is coupled to or configured as part of the tool board. In another embodiment, the system is configured so that when the system is positioned upon a lip of an aerial bucket, the first tray is located above the lip and the tool board is positioned within the aerial bucket. In yet embodiment, the system further comprises a second tray coupled to or configured as part of the tool board, the second tray comprising a second interior tray section and a second ramp in communication with the second interior tray section. In an additional embodiment, the system further comprises one or more components coupled to a front portion of the tool board. In yet an additional embodiment, the system further comprises a stanchion formed in or coupled to interior tray section, the stanchion configured to engage a removable dowel, and the removable dowel, configured to reversibly engage the stanchion.

In at least one exemplary embodiment of a system of the present disclosure, the system comprises a first tray, comprising an interior tray section configured to receive one or more items, the interior tray at least partially surrounded by at least one sidewall having a height, and a first ramp portion in communication with the interior tray section, the first ramp portion defining a sloping surface that extends from the interior tray section to a top of the at least one sidewall; and at least one additional component connected thereto. In an additional embodiment, the first tray further comprises at least one attachment saddle coupled to the interior tray section, the at least one attachment saddle configured to receive a portion of an aerial bucket hook, and wherein the at least one additional component comprises a stanchion coupled to the tray. In another embodiment, the system further comprises a dowel configured for reversible engagement with the stanchion. In yet another embodiment, the at least one additional component comprises a tool board coupled to the tray.

In at least one exemplary embodiment of a tray of the present disclosure, the tray comprises an interior tray section configured to receive one or more items, the interior tray at least partially surrounded by at least one sidewall having a height, a first ramp portion in communication with the interior tray section, the first ramp portion defining a sloping surface that extends from the interior tray section to a top of the at least one sidewall, wherein the at least one tray is configured to be secured to an inner lip of an aerial bucket liner. In at least one exemplary embodiment of a tray of the present disclosure, at least one tray notch is defined within the at least one sidewall, the at least one tray notch configured to receive at least part of at least one aerial bucket hook used to secure the tray to an aerial bucket or an aerial bucket liner. In at least one exemplary embodiment of a tray of the present disclosure, the at least one sidewall comprises at least two sidewalls, and the at least one tray notch comprises at least two tray notches defined within each of the at least two sidewalls.

In at least one exemplary embodiment of a tray of the present disclosure, the tray further comprises a tool board extending from the tray. In at least one exemplary embodiment of a tray of the present disclosure, the tray comprises at least one outer lip and at least one front portion. In at least one exemplary embodiment of a tray of the present disclosure, when the tray is positioned upon the aerial bucket and the at least one aerial bucket hook is positioned within the at least one tray notch, the tray is secured to the aerial bucket. In at least one exemplary embodiment of a tray of the present disclosure, when the tray is positioned upon the aerial bucket liner and the at least one aerial bucket hook is positioned within the at least one tray notch, the tray is secured to the aerial bucket liner. In at least one exemplary embodiment of a tray of the present disclosure, the tray further comprises a front flange and a back flange extending from the tray, the front flange and the back flange configured to secure the tray to a tool board when the tray is positioned upon the tool board. In at least one exemplary embodiment of a tray of the present disclosure, the tray further comprises at least one extension flange having an aperture defined therethrough, whereby the tray can be secured to a tool board using a fastener positioned within the aperture. In at least one exemplary embodiment of a tray of the present disclosure, the tray further comprises at least one inner divider having an aperture defined therethrough, whereby the tray can be secured to a tool board using a fastener positioned within the aperture.

In at least one exemplary embodiment of a tray of the present disclosure, the tray further comprises a second ramp portion in communication with the interior tray section, the second ramp portion defining a second sloping surface that extends from the interior tray section to the top of the at least one sidewall. In at least one exemplary embodiment of a tray of the present disclosure, the second ramp is located opposite the first ramp. In at least one exemplary embodiment of a tray of the present disclosure, the second ramp is located adjacent to the first ramp. In at least one exemplary embodiment of a tray of the present disclosure, the tray is formed of a non-conductive material. In at least one exemplary embodiment of a tray of the present disclosure, the tray has an outer shape selected from the group consisting of a rectangular shape, a square shape, and a round shape.

In at least one exemplary embodiment of a tray of the present disclosure, the tray comprises an interior tray section configured to receive one or more items, the interior tray at least partially surrounded by at least one sidewall having a height, a first ramp portion in communication with the interior tray section, the first ramp portion defining a sloping surface that extends from the interior tray section to a top of the at least one sidewall, at least one tray notch defined within the at least one sidewall, the at least one tray notch configured to receive at least part of at least one aerial bucket hook therethrough used to secure the tray to an aerial bucket or an aerial bucket liner, and a tool board extending from the tray. In at least one exemplary embodiment of a tray of the present disclosure, the tray comprises at least one outer lip and at least one front portion. In at least one exemplary embodiment of a tray of the present disclosure, the tray further comprises a second ramp portion in communication with the interior tray section, the second ramp portion defining a second sloping surface that extends from the interior tray section to the top of the at least one sidewall.

In at least one exemplary embodiment of a tray of the present disclosure, the tray comprises an interior tray section configured to receive one or more items, the interior tray at least partially surrounded by at least two sidewalls having a height, a first ramp portion in communication with the interior tray section, the first ramp portion defining a sloping surface that extends from the interior tray section to a top of the at least one sidewall, at least two tray notches defined within each of the at least two sidewalls, each of the at least two tray notches configured to receive at least part of at least one aerial bucket hook therethrough used to secure the tray to an aerial bucket or an aerial bucket liner, and a tool board extending from the tray. In at least one exemplary embodiment of a tray of the present disclosure, the tray comprises at least one outer lip and at least one front portion, and wherein the tray is formed of a non-conductive material.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1A:
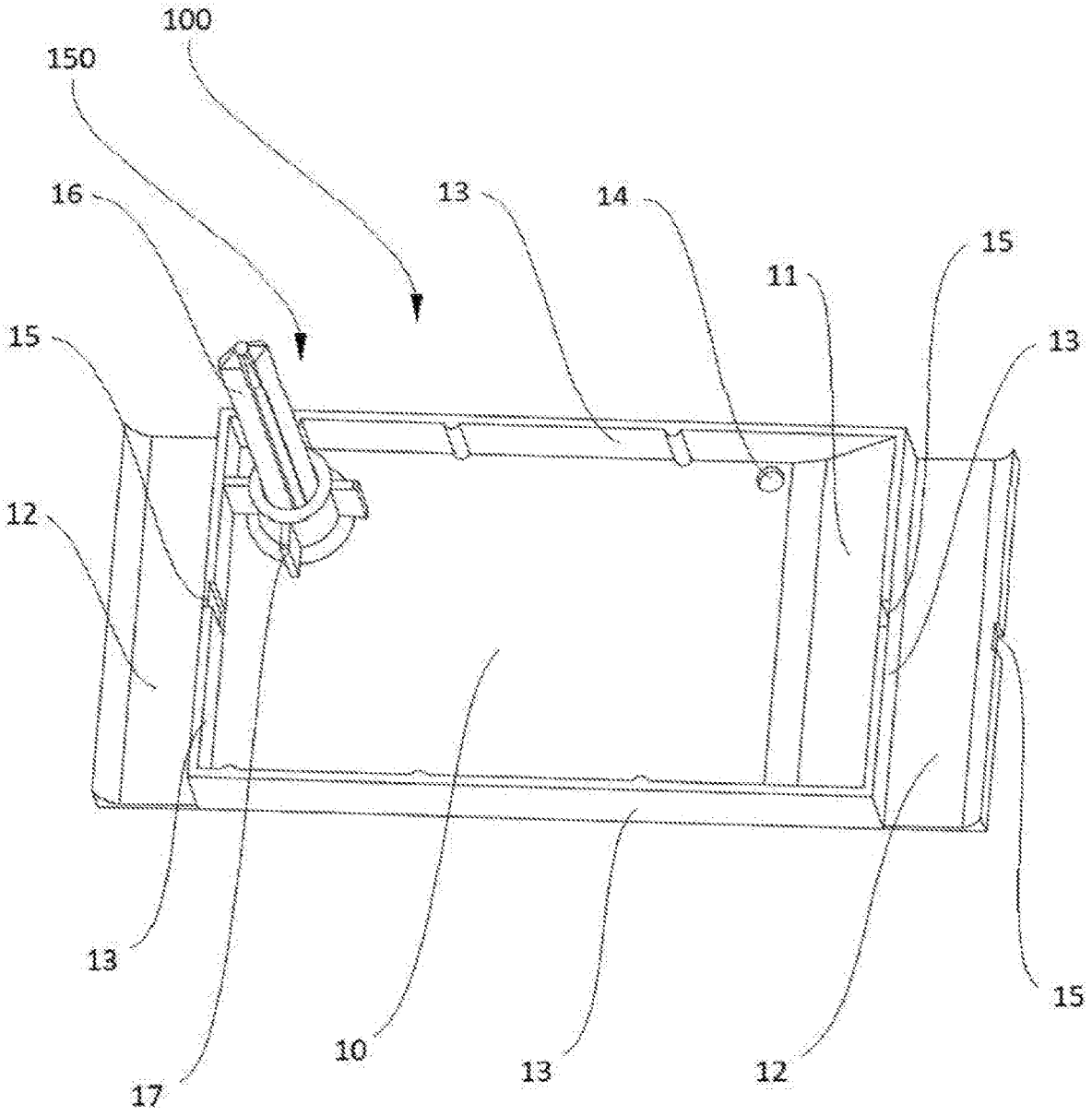
FIGS. 1A and 1B show a substantially top down view of an exemplary embodiment of a tray, according to exemplary embodiments of the present disclosure.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

The terminology used herein is for the purpose of describing particular embodiments only and is not intended to be limiting of the present disclosure. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing embodiments of the present disclosure, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New devices and apparatuses such as trays for use with elevated work stations and gloved hands are discussed. In the following description, for purposes of explanation, numerous specific details are set forth in order to provide a thorough understanding of the present disclosure. It will be evident, however, to one skilled in the art that trays and systems of the present disclosure may be practiced without these specific details.

The present disclosure is to be considered as an exemplification of the invention, and is not intended to limit the invention to the specific embodiments illustrated by the figures or description below.

Figure 1B:
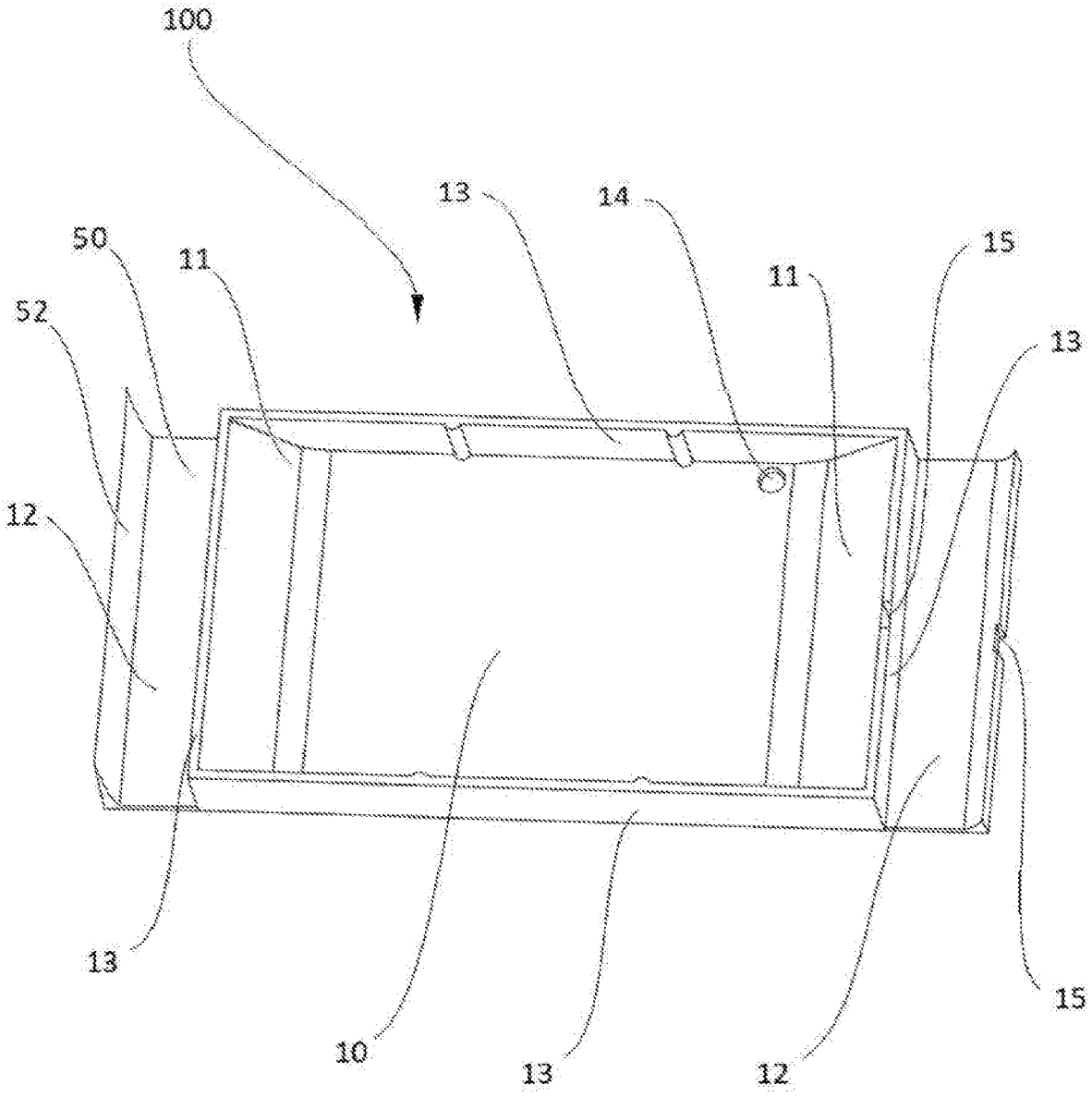
Figure 9A:
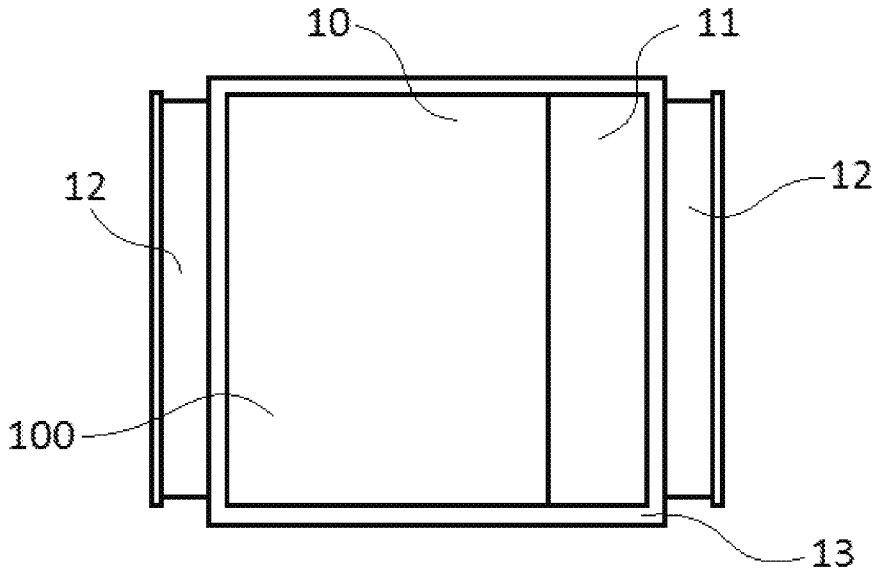
FIGS. 9A and 9B show top down views of a square tray and a round tray, respectively, according to exemplary embodiments of the present disclosure.
Figure 9B:
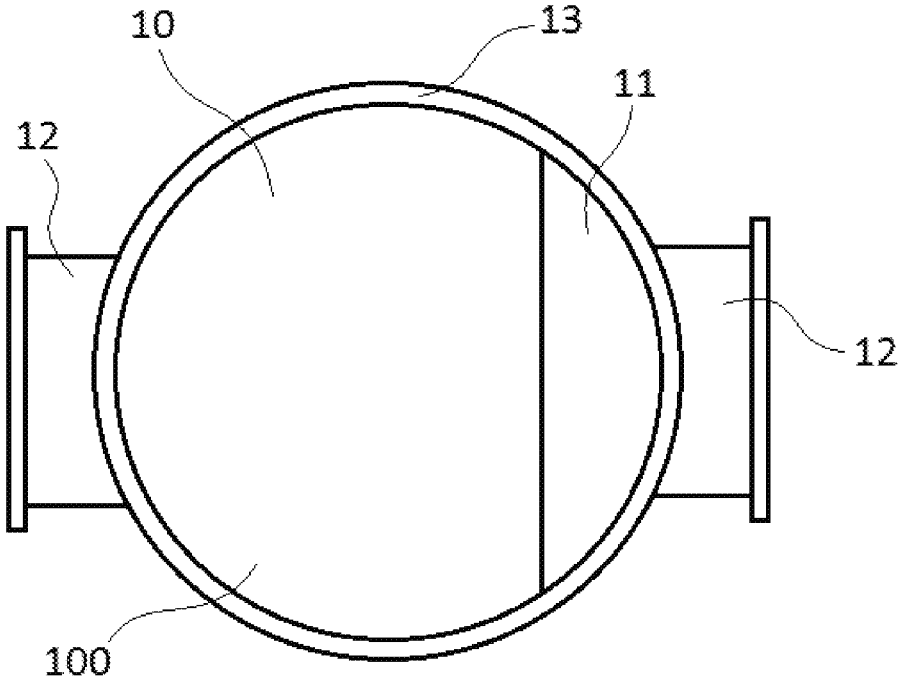

Various embodiments of the present disclosure will now be described by referencing the appended figures representing preferred embodiments. FIGS. 1A and 1B illustrates substantially top down views of exemplary embodiment of the present disclosure. In the examples shown in FIGS. 1A and 1B, tray 100 comprises an interior tray section 10 (also referred to as an interior tray base section 10) and one or more attachment saddles 12. The interior tray base section 10, as shown in FIGS. 1A and 1B, is formed and bound by four raised sidewalls 13, noting that in other embodiments the number of sidewalls 13 may differ, as provided in further detail herein. In some embodiments, the sidewalls 13 are 0.75 inches in height. In other embodiments, the sidewalls 13 may be between 0.5 inches and 3 inches in height, but other sizes and heights are contemplated herein. Furthermore, various relative "shapes" of trays 100 of the present disclosure, defined by an outer perimeter shape of one or more sidewalls 13, are contemplated herein, such as a rectangular shape (as shown in FIGS. 1A and 1B), a square shape (such as shown in FIG. 9A), a round shape (such as shown in FIG. 9B), and other potential shapes.

In the example shown by FIGS. 1A and 1B, the two attachment saddles 12 provide a means for accepting attachment devices configured to attach the tray 100 to an elevated workstation. In some preferred embodiments, the attachment saddles 12 are able to accept aerial bucket hooks 202 (as referenced in further detail herein) which fit over the attachment saddles 12 and around the lip of an aerial bucket. These aerial bucket hooks are common in the art and are used to hang tool bags, tool aprons, and the like to the lip of aerial buckets. In some embodiments, the tray 100 comprises one attachment saddle 12. In other embodiments, the tray 100 comprises two, three, or more attachment saddles 12. Attachment saddles 12, as shown in FIGS. 1A and 1B, may extend beyond interior tray section 10 in various directions. In addition, and as shown in FIG. 1B, the overall depth of attachment saddle 12 can vary, with a deeper attachment saddle 12 shown on the left side of tray 100 as compared to the attachment saddle 12 shown on the right side. As shown in FIG. 1B, an exemplary attachment saddle 12 of the present disclosure comprises an extension portion 50 (which can be considered as extending from tray 100, or extending out from a sidewall 13, for example), and a ridge portion 52, which is generally perpendicular, or at an angle of between 30° and 150°, for example, from extension portion 50. An exemplary aerial bucket hook 202, as referenced in further detail herein, can fit within attachment saddle 12 at extension portion 50, and is prevented from moving sideways due to the positioning of sidewall 13 adjacent to aerial bucket hook 202 and ridge portion 52. Depths of attachment saddles 12, as referenced herein, relates to a relative height of ridge portion 52 relative to extension portion 50, for example. Attachment saddles 12 can have various widths, lengths, and depths, depending on the desired embodiment. In addition, the configuration of an exemplary attachment saddle 12 is such that when an exemplary tray 100 is in use (and one or more aerial bucket hooks 202 are used with tray 100), tray 100 is retained by aerial bucket hook(s) 202 and cannot slide away from aerial bucket hook(s) 202 without moving aerial bucket hook(s) 202 in a way to disengage tray 100.

In some embodiments, the tray 100 comprises one or more ramps 11 (also referred to herein as a ramp portion 11). The ramp 11 forms a sloping surface that extends from the base of the tray interior base section 10 up to the top of a sidewall 13. This ramp 11 allows the user to slide hardware located on the interior tray section 10, up to the top edge of the sidewall 13, thereby facilitating the retrieval and manipulation of tools and hardware with gloved hands, for example. In various embodiments, and as shown in FIG. 1A, tray 100 comprises one ramp 11. In other embodiments, tray 100 may comprise two ramps 11 (as shown in FIG. 1B) providing a sloped surface to the tops of two separate sidewalls 13. In other embodiments, the tray 100 comprises three ramps 11 providing a sloped surface to the tops of three separate sidewalls 13. In still further embodiments, each of four sidewalls 13 of an exemplary tray 100 embodiment have a ramp 11 providing a sloped surface from the interior tray base section 10 to the top of each sidewall 13.

In some embodiments, and still referring to FIGS. 1A and 1B, the tray 100 may define one or more drain holes 14 which allow water or other liquids to exit the interior tray section 10. For example, and if the tray is positioned so that the view in FIGS. 1A and 1B faces upward as shown, rainwater entering tray 100 can drain through one or more drain holes 14 and out of tray 100. In various tray 100 embodiments of the present disclosure, tray 100 contains one or more mounting slots 15, also as shown in FIG. 1A. The mounting slots 15 are configured to accept attachment devices, such as self-locking cable ties, for securing the tray 100 to aerial bucket lips, scaffolding, and other types of elevated workstations, for example.

In some preferred embodiments, the tray 100 may comprise a stanchion 17 and an optionally a removable dowel 16 oriented in a vertical position above the tray 100, as shown in FIG. 1A. Dowel 16 provides a means for stacking and staging hardware, such as nuts, washers, and the like. Stanchion 17 keeps the hardware on dowel 16 from resting on interior tray section 10, thereby providing a large space for gloved fingers to grasp the lowermost hardware stacked on dowel 16. Dowel 16 may be removed from the stanchion 17 by any number of means, such as by a twisting and lifting motion, for example, and attached to the stanchion 17 by a reverse twisting and insertion motion. An exemplary system 150 of the present disclosure, as shown in FIG. 1A, comprises a tray 100 and at least one additional component, such as, for example, a dowel 16 and/or a stanchion 17. Other system 150 embodiments are referenced in further detail herein. Tray embodiments do not require a dowel 16 or a stanchion 17, as shown in FIG. 1B.

Figure 2:
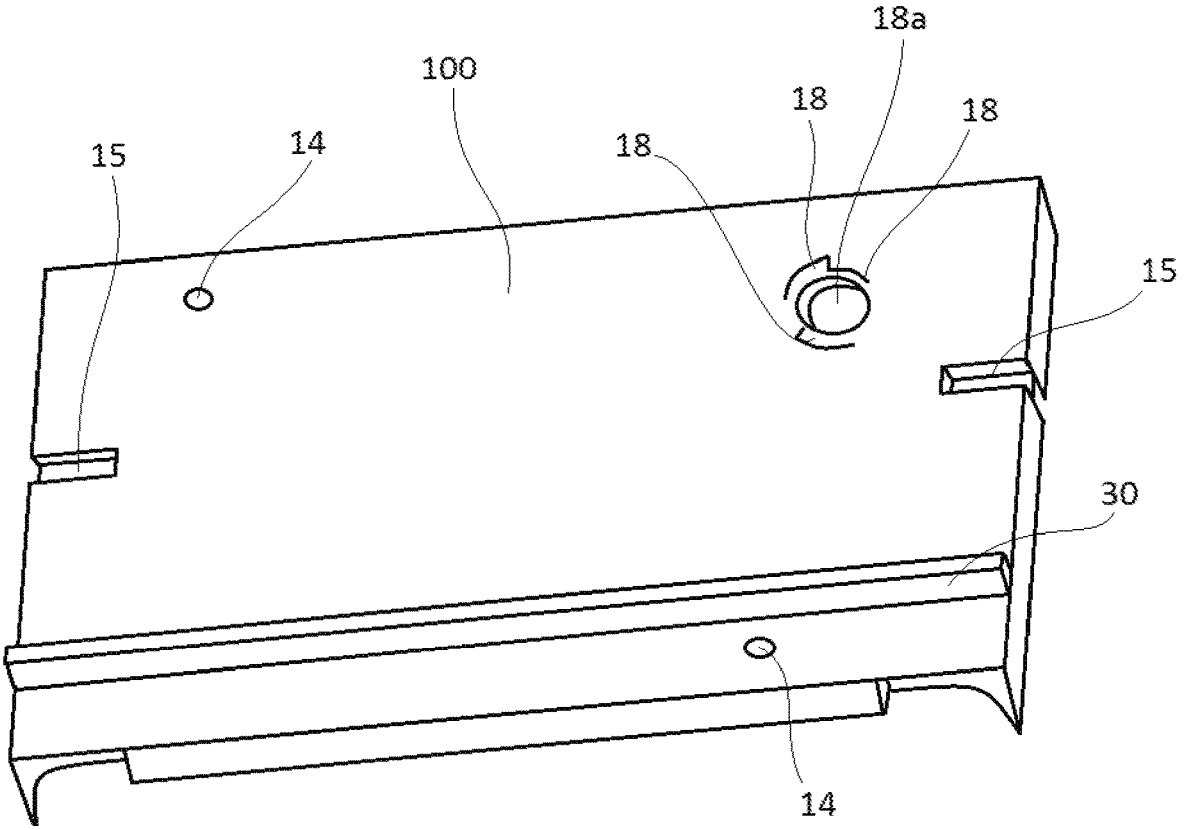
FIG. 2 shows a substantially bottom up view of an exemplary embodiment of a tray, according to an exemplary embodiment of the present disclosure.
Figure 3:
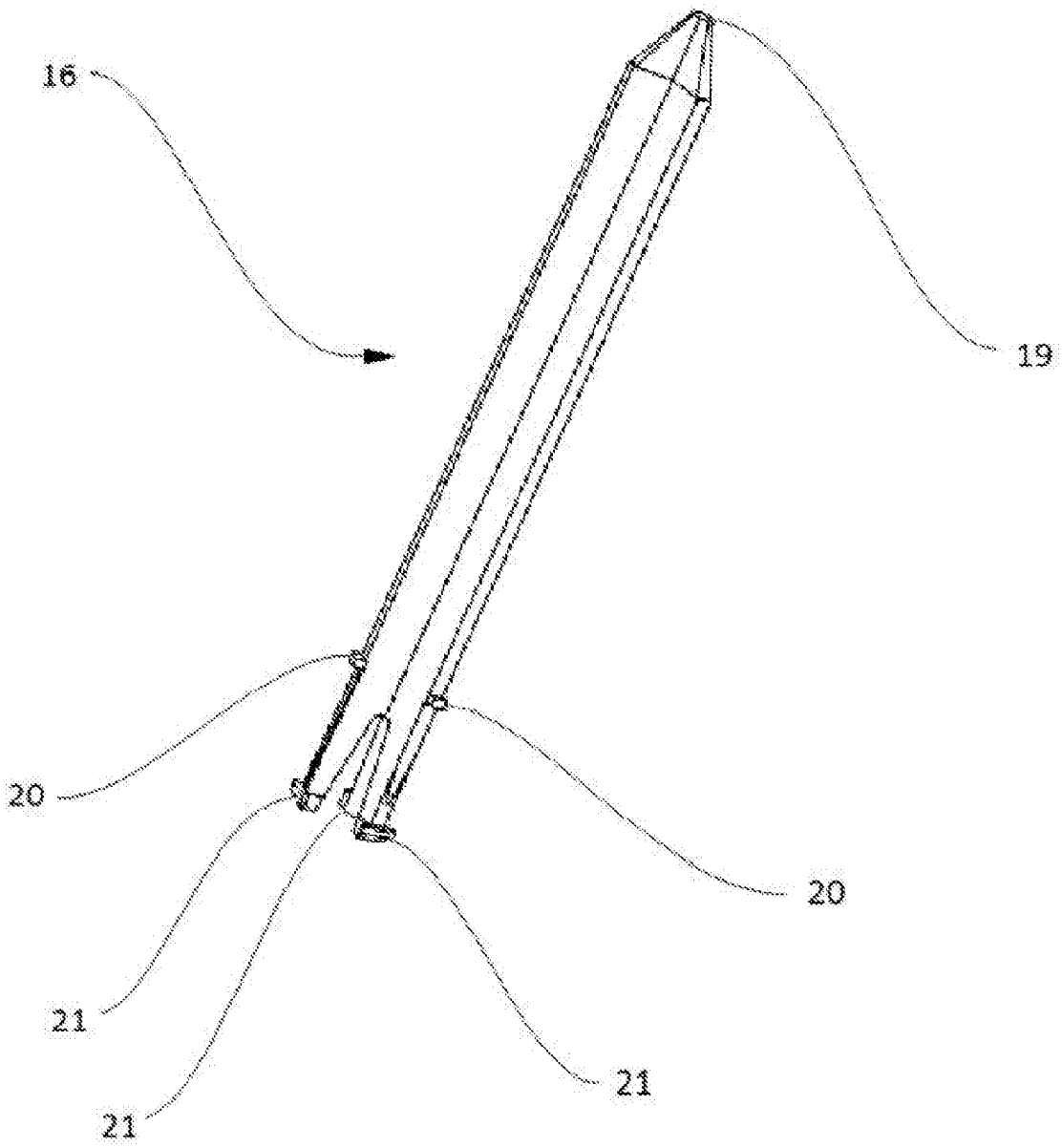
FIG. 3 shows a side view of a removably attachable dowel, according to an exemplary embodiment of the present disclosure.

FIG. 2 illustrates a substantially bottom up view of an example of a tray 100 according to various embodiments of the present disclosure. In this example, tray 100 is shown with two drain holes 14 and two mounting slots 15. Also shown is an aperture 18*a* configured to receive the base of the removable dowel 16. In some embodiments, the aperture 18*a* may be surrounded by female grooved notches 18 which are configured to accept the base of the dowel 16 as depicted in FIG. 3. FIG. 2 also shows an exemplary lip 30, extending outward from underside of tray 100, so to limit potential movement of tray 100 relative to an aerial bucket or componentry used in connection therewith. For example, and with tray embodiments having lip 30, lip 30 may either rest against a portion of an aerial bucket or componentry used in connection therewith, or otherwise prevent movement of tray 100 past said portion or componentry, for example.

FIG. 3 illustrates a side view of a removable dowel 16 according to various embodiments of the present disclosure. Dowel 16 may have a substantially blunt pointed end 19 capable of accepting hardware such as nuts and washers. Dowel stop guides 20, in various embodiments, prevent dowel 16 from being over inserted into stanchion 17. In the example shown in FIG. 3, dowel 16 terminates into three notched sections 21, which when inserted and twisted into aperture 18*a* depicted in FIG. 2, compress and lock into grooved notches 18. Twisting dowel 16 in the reverse direction and pulling disengages and decompresses notched sections 21 from grooved notches 18 depicted in FIG. 2 allowing removal of dowel 16 from aperture 18*a* and tray 100. Dowel 16 may be of a diameter capable of accepting a wide size range of hardware common in the art. In some embodiments, dowel 16 may be about 0.5 inches in diameter. In other embodiments, dowel 16 diameter may be between 0.25 inches and 3 inches. In some embodiments, dowel 16 is about 3.5 inches in length. In other embodiments, dowel 16 is between 3 inches and 8 inches. In further embodiments the dowel 16 is between 2 inches and 12 inches or any suitable length or diameter.

Although a specific example is provided for a dowel 16 by FIG. 3, other shapes and sizes of dowels or vertical rods are contemplated herein which may be permanently or removably attached to a tray 100 in accordance with various embodiments of the present disclosure.

Figure 4:
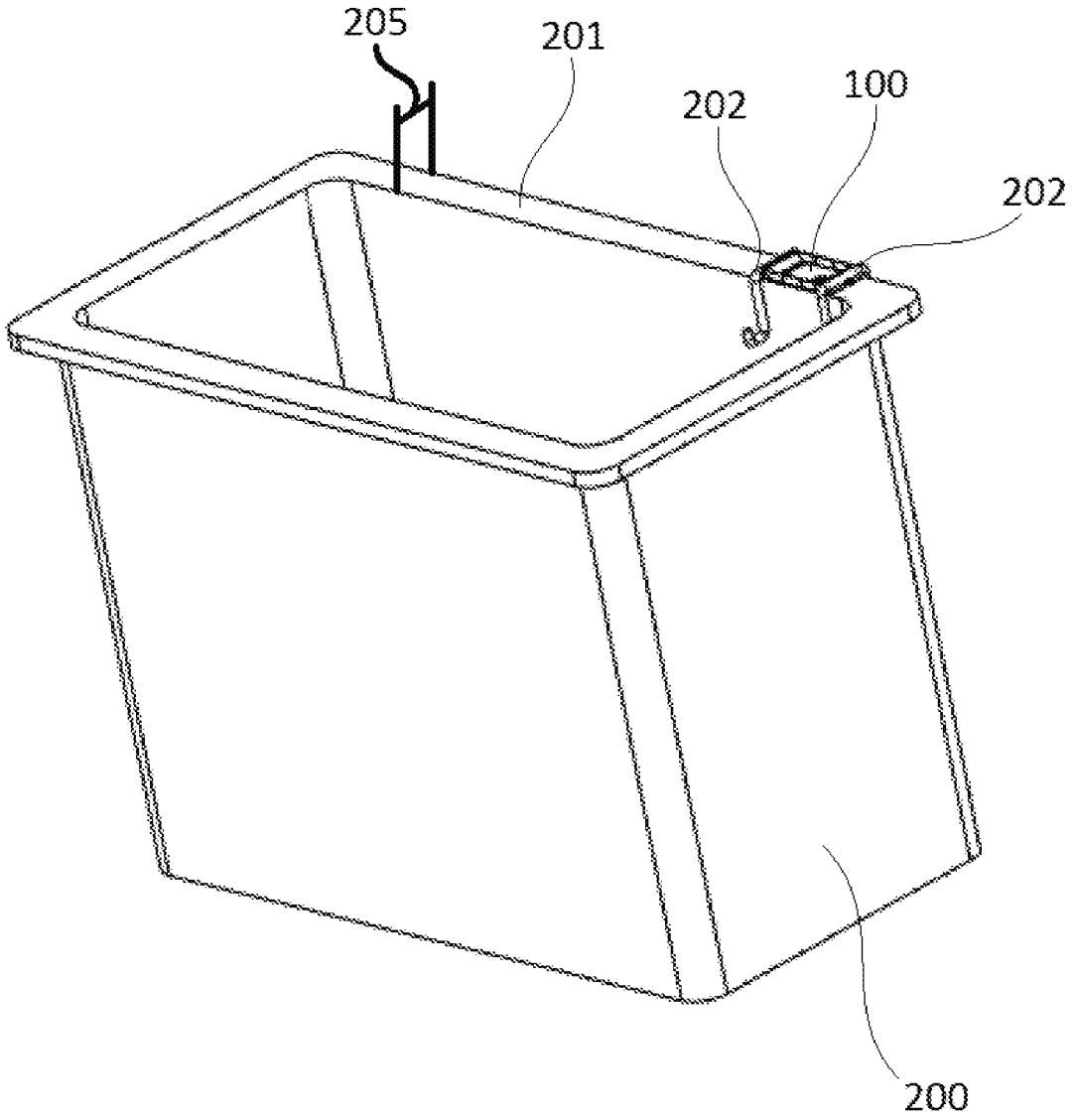
FIG. 4 depicts a substantially top down view showing an example of a tray with dowel attached to the lip of an aerial bucket, according to an exemplary embodiment of the present disclosure.

FIG. 4 depicts a substantially top down view showing an example of a tray 100 attached to a lip 201 of an aerial bucket 200 (sometimes called an "aerial work station"). In this example, tray 100 is secured to aerial bucket lip 201 by two aerial bucket hooks 202. Aerial bucket hooks 202 fit into the attachment saddles 12 depicted in FIGS. 1A and 1B providing a removable attachment means. In some embodiments, trays 100 of the present disclosure are configured for use with aerial bucket lips 201 that are about 3 inches in width (as indicated by width 205 in FIG. 4), resulting in a tray 100 with a width of about 3 inches. In other embodiments, trays 100 of the present disclosure are configured for use with aerial bucket lips 201 that are about 2 inches in width 205, resulting in a tray 100 with a width of about 2 inches. In further embodiments, trays 100 of the present disclosure are configured for use with aerial bucket lips 201 that are a width 205 common in the art, resulting in a corresponding width of the tray 100 that may be the same width as the width of the aerial bucket lip 201, or even a smaller or larger width than the aerial bucket lip 201. For example, and in at least one embodiment, an exemplary tray 100 of the present disclosure has a width of or about 3", noting that an exemplary aerial bucket lip 201 is at or about 2.5". An exemplary bucket hook 202, as referenced herein, is larger than a corresponding width of an aerial bucket lip 201 due to the radius needed to extend around the aerial bucket lip 201, which in various embodiments is thick and straight and generally has no radius at the outer lip and an approximate 0.5" radius at the inner lip. As such, an exemplary aerial bucket lip 201 has a width of 2.5", including the inner radius, and a corresponding tray 100 with a 3" width would fit thereon and be held in place using one or more bucket hooks 202. In some embodiments, the length of tray 100 may be about 6 inches. In other embodiments, tray 100 may be between 4 inches and 10 inches in length. In further embodiments, tray 100 may be longer than 10 inches. In some embodiments, tray 100 may comprise more than two attachment saddles 12, two or more dowels 16, two or more interior tray sections 10, and/or two or more stanchions 17.

Figure 5A:
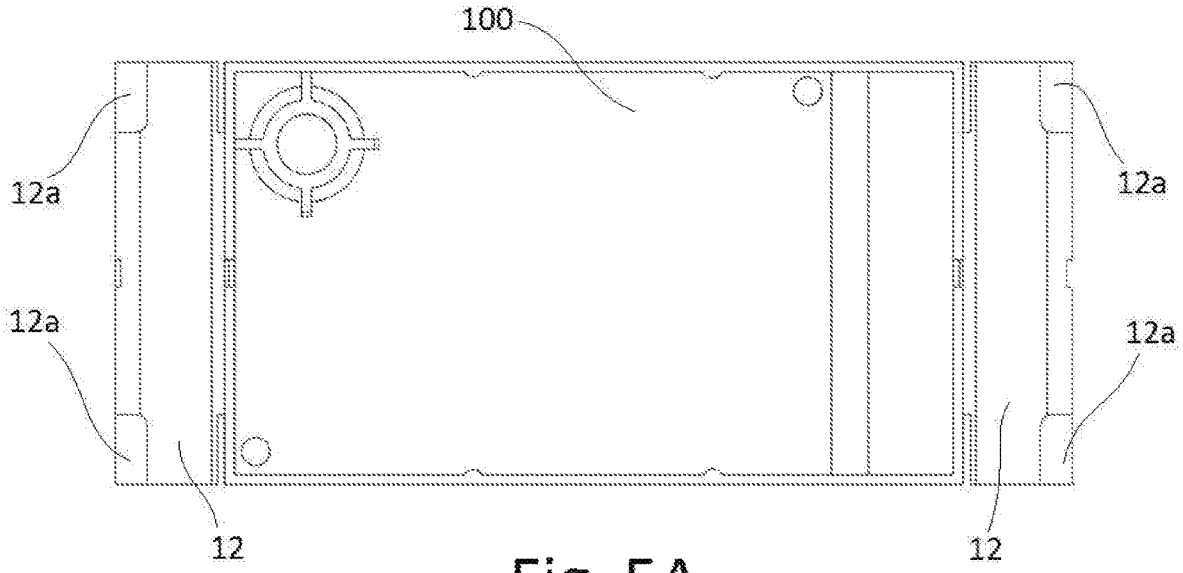
FIG. 5A shows an example of a tray wherein the tray comprises two attachment saddles on each end with each attachment saddle containing at least one stress relief section, according to an exemplary embodiment of the present disclosure.
Figure 5B:
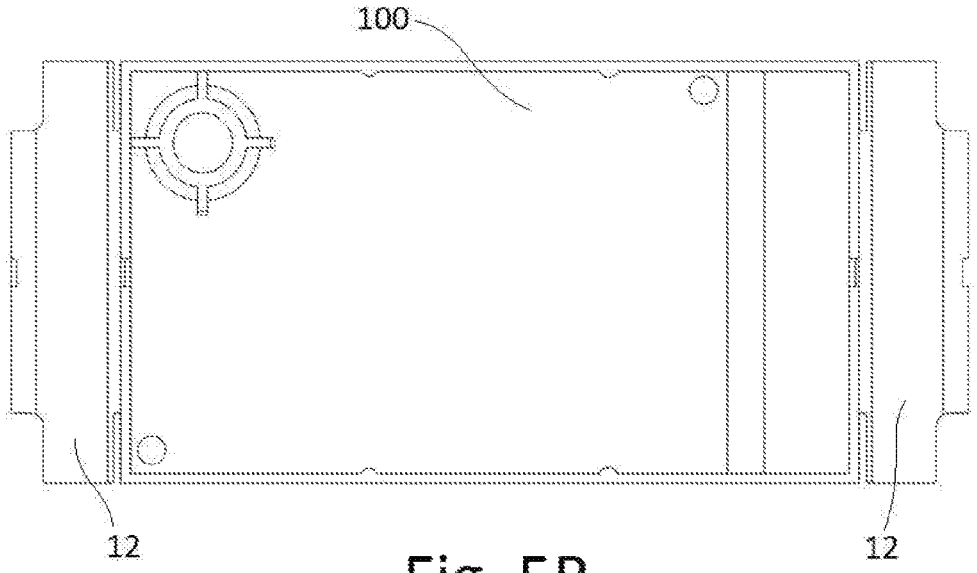
FIG. 5B shows a tray having two attachment saddles but no stress relief sections, according to an exemplary embodiment of the present disclosure.

FIG. 5A shows an example of a tray 100, whereby tray 100 comprises two attachment saddles 12 on each end, with each attachment saddle 12 comprising at least one stress relief section 12*a*. The one or more stress relief sections 12*a* or cutout sections are designed to reduce the stress placed onto the attachment saddle 12 and tray 100 by attachment devices such as aerial bucket hooks 202 which may be weighed down by bags containing heavy tools and equipment. FIG. 5B shows a tray 100 embodiment of the present disclosure without stress relief sections 12*a*.

Figure 6:
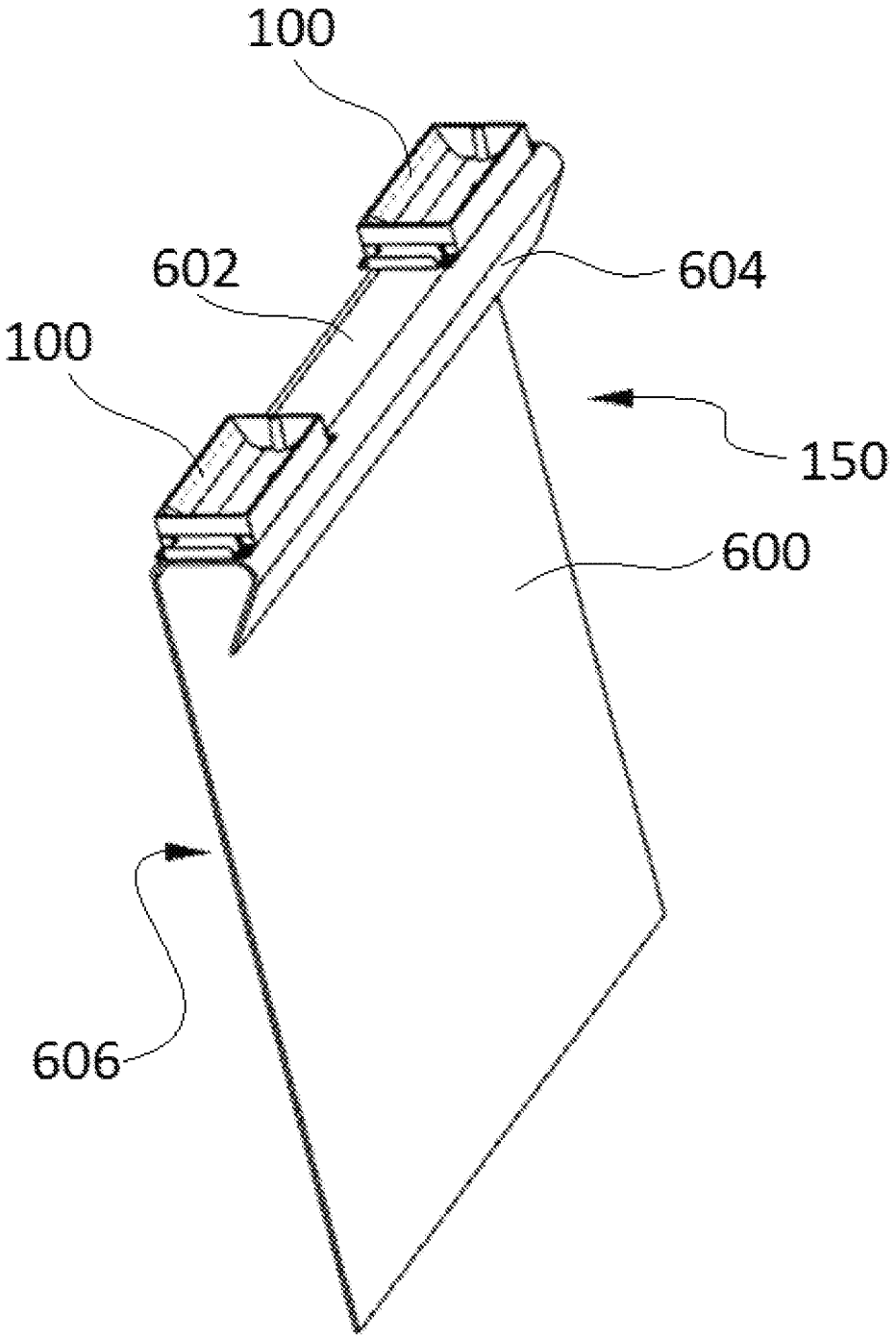
FIG. 6 shows a perspective view of a system comprising a tool board and two trays, according to an exemplary embodiment of the present disclosure.

FIG. 6 shows an exemplary system 150 embodiment of the present disclosure, comprising at least one tray 100 (two trays 100 shown in the exemplary embodiment) and a tool board 600, whereby tray(s) 100 are coupled to, or formed as part of, tool board 600. Tool boards 600 are configured to couple to (or rest upon) part of aerial bucket 200, such as at bucket lip 201, so that an underside of an upper portion 602 of tool board 600 rests upon bucket lip 201. Tray(s) 100, as shown in FIG. 6, are configured for placement at upper portion 602 of tool board 600, so that the innermost portion of tray 100 faces upward and can receive items such as nuts, bolts, and washers, for example. Tool boards 600, in various embodiments, comprise or have an outer lip 604 formed thereon or therein, so that when tool board 600 is placed upon bucket lip 201, tool board 600 will not fall off of aerial bucket 200 due to outer lip 604 on one side and front panel 606 of tool board 600 on the other side (whereby front panel 606 extends downward from upper portion 602 as shown in FIG. 6), and inside an aerial bucket 200 when in use.

Figure 7A:
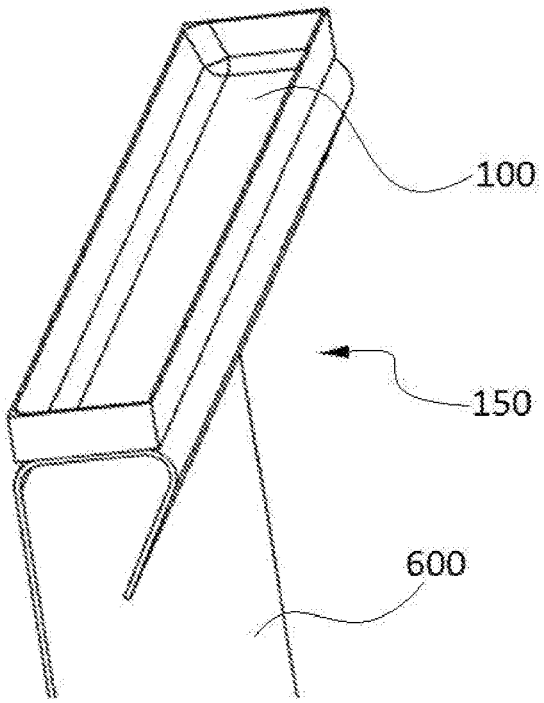
FIG. 7A shows a perspective view of an upper portion of a system, according to an exemplary embodiment of the present disclosure.

FIG. 7A shows a perspective view of an upper portion of an exemplary system 150 of the present disclosure, comprising one tray 100 and a tool board 600, whereby tray 100 and tool board 600 are coupled to one another or formed as a unitary piece (such as a one-piece manufactured piece). In such a system 150 embodiment, for example, tray 100 (referred to as tray portion 100 of system 150) would not require attachment saddles 12, as tray 100 would be coupled to, or formed as part of, tool board 600, and tool board 600 would be configured to rest on aerial bucket 200 when in use. Tray 100 (or tray portion 100) could have attachment saddles 12 in such an embodiment, but they would not be necessary as bucket hooks 202 would not be used.

Figure 7B:
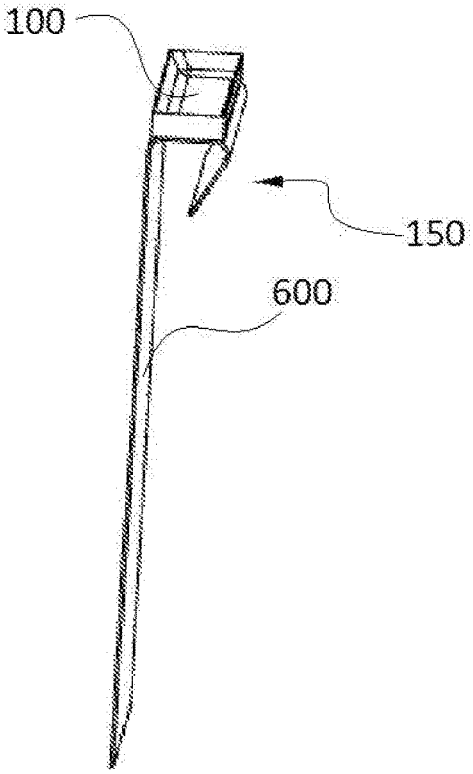
FIG. 7B shows a perspective view of a system comprising a tool board and one tray, according to an exemplary embodiment of the present disclosure.
Figure 7C:
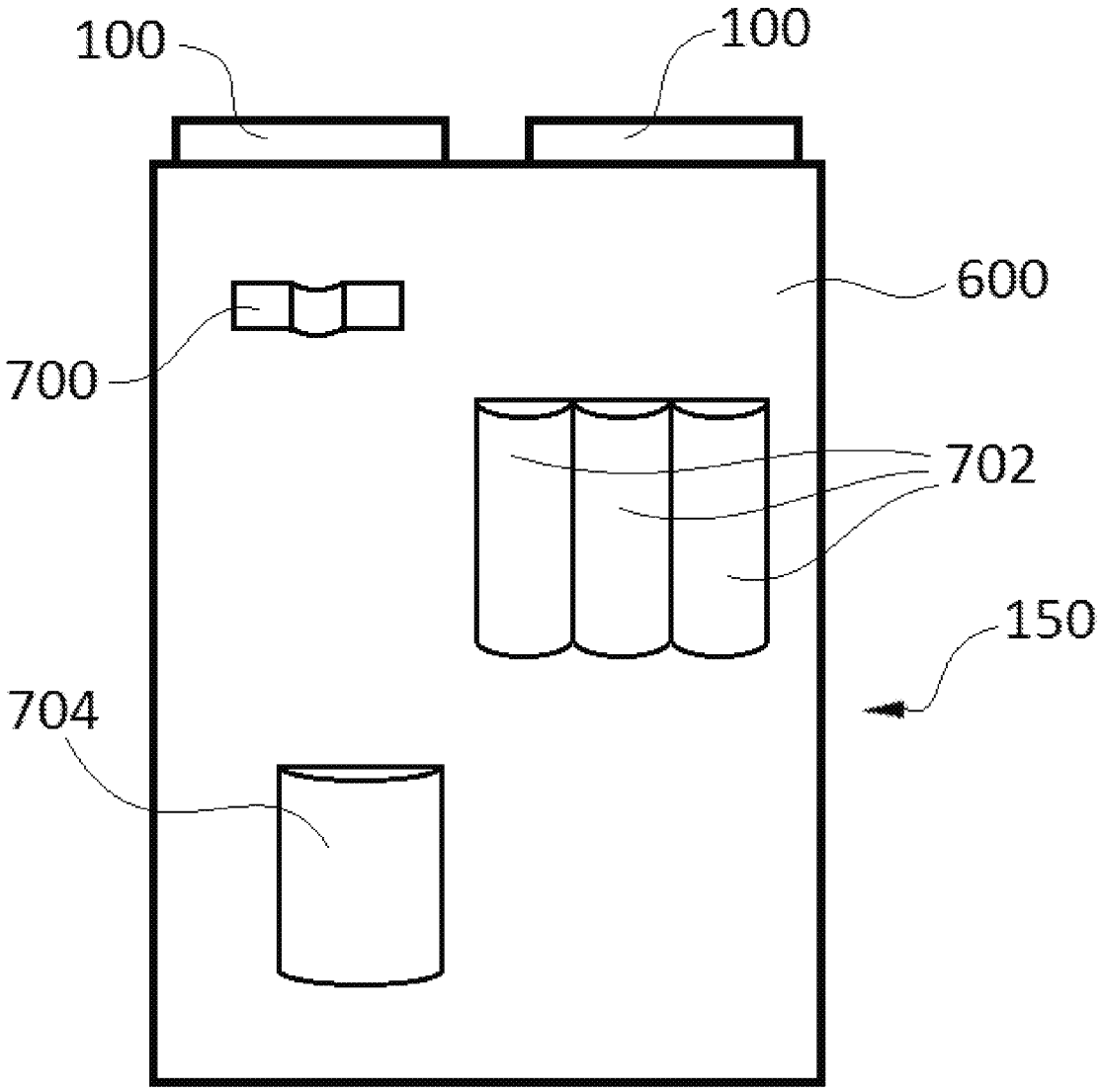
FIG. 7C shows a front view of a system comprising a tool board with one or more features/components thereon and two trays, according to an exemplary embodiment of the present disclosure.

FIG. 7B shows a side perspective view of an exemplary system 150 of the present disclosure, comprising a tray 100 and a tool board 600. FIG. 7C shows an exemplary system 150 of the present disclosure, with a tool board 600, two trays 100 (noting that one or more trays 100 could be used), and one or more other features, such as, for example, one or more loops 700 configured to retain one or more tools, for example, one or more pockets 702, and/or one or more pouches 704 coupled thereto and/or otherwise defined thereon. For example, and in at least one system 150 embodiment, a user of system 150 could place nuts and bolts within tray 100, for example, and store tools within one or more of a loop 700, pocket 702, and/or pocket 704 of tool board 600.

Figure 8:
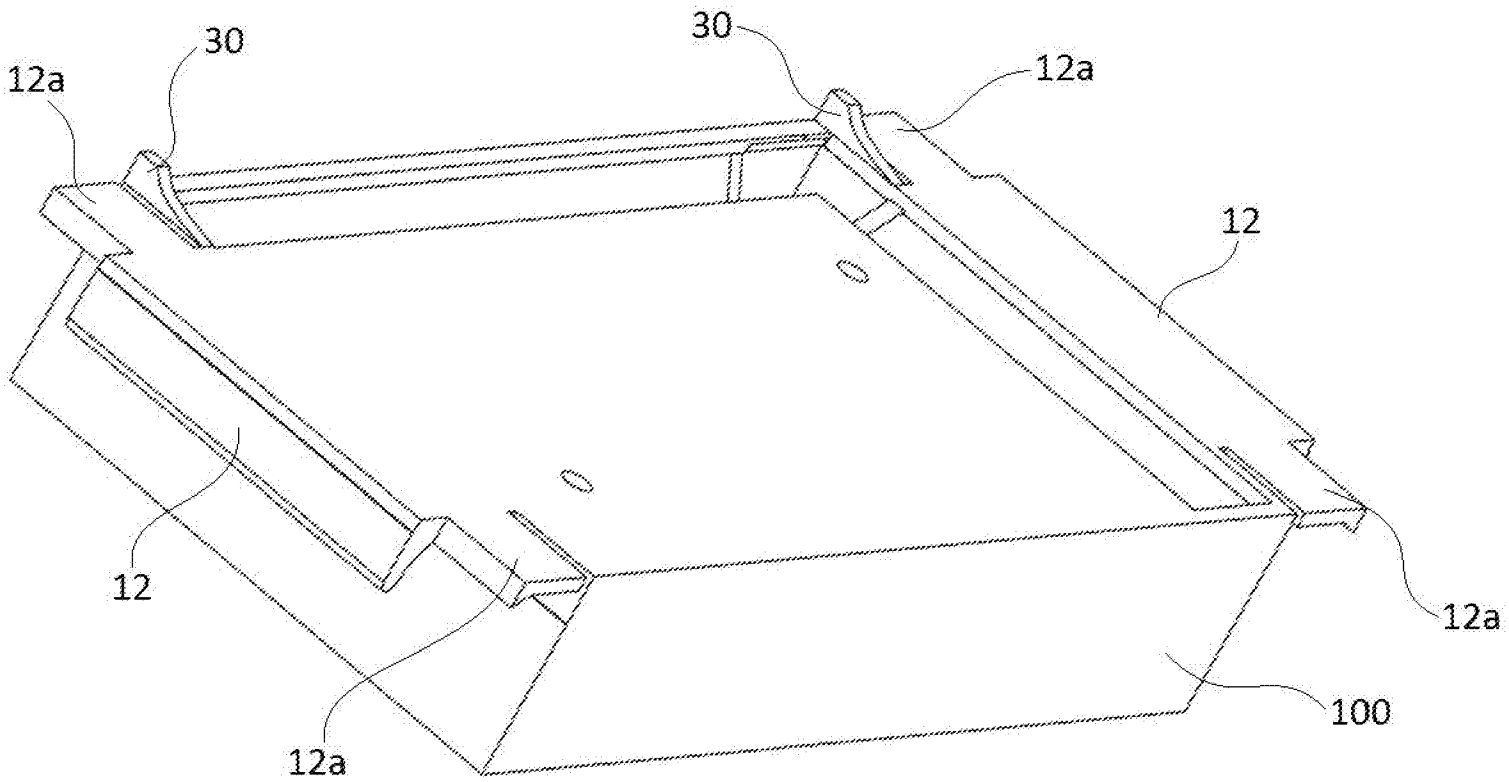
FIG. 8 shows an underside perspective view of a tray, according to an exemplary embodiment of the present disclosure.

FIG. 8 shows a perspective view of an underside of an exemplary tray 100 of the present disclosure. As shown therein, tray 100 comprises two lips 30, extending outward from underside of tray 100, so to limit potential movement of tray 100 relative to an aerial bucket or componentry used in connection therewith.

Figure 9C:
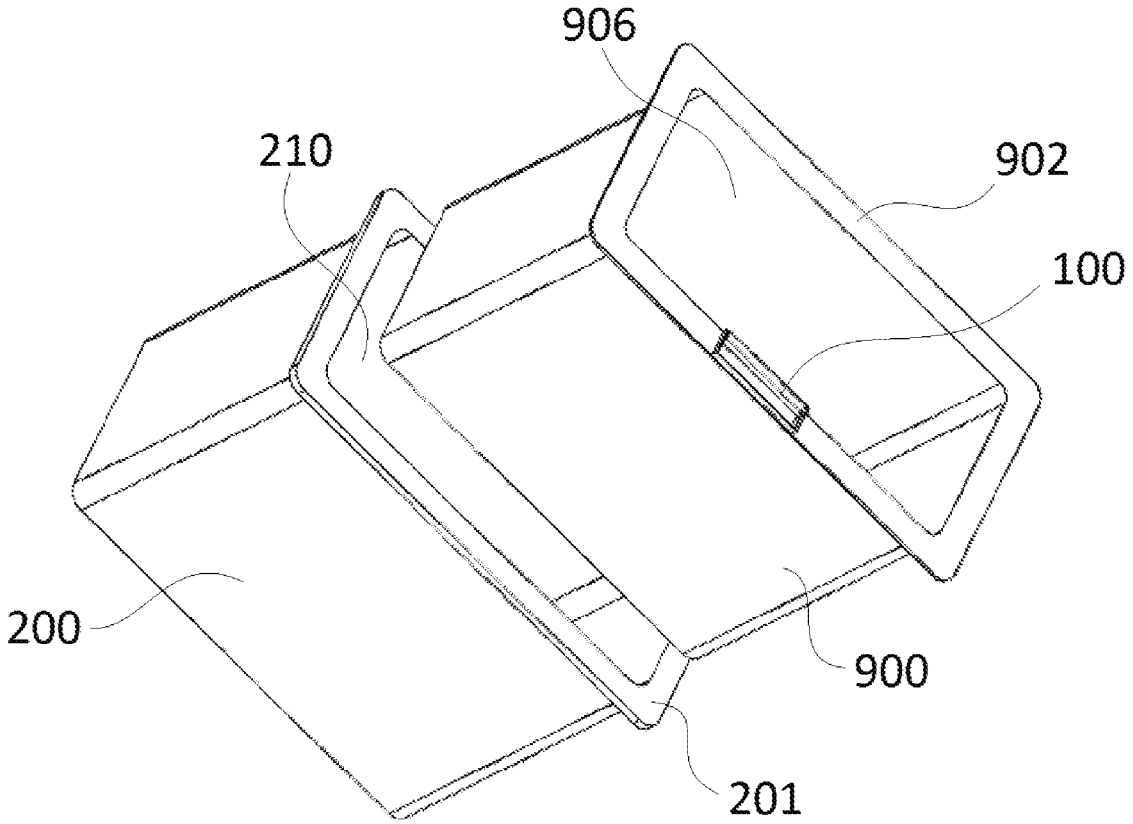
FIG. 9C shows a perspective view of an aerial bucket liner configured to fit within an aerial bucket, according to an exemplary embodiment of the present disclosure.
Figure 10:
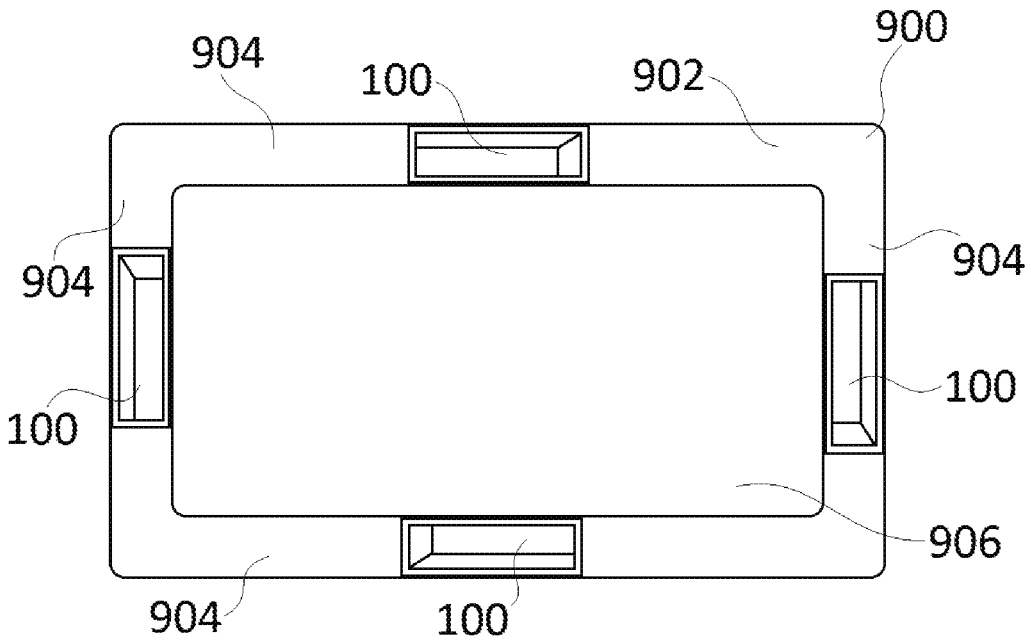
FIG. 10 shows a top-down view of a bucket liner having one or more trays, according to an exemplary embodiment of the present disclosure.
Figure 11:
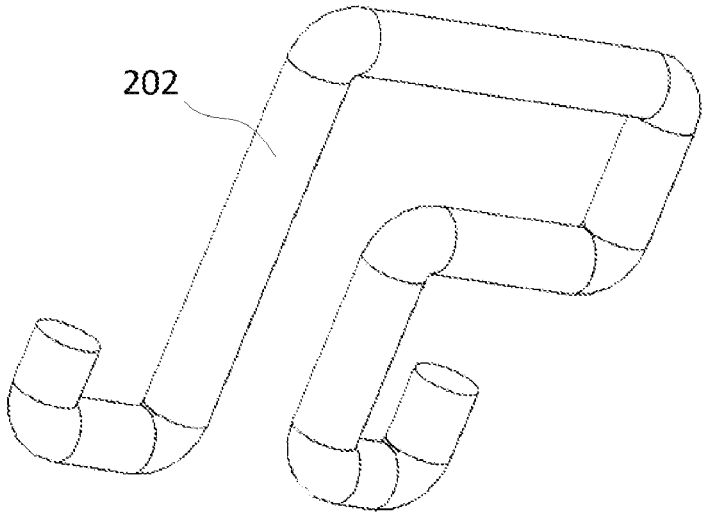
FIG. 11 shows an aerial bucket hook, according to an exemplary embodiment of the present disclosure.

FIG. 9C shows a perspective view of an exemplary aerial bucket 200 as previously referenced herein, along with an exemplary bucket liner 900 of the present disclosure. As shown in FIG. 9C, bucket liner 900 is configured for insertion into an opening 210 of aerial bucket 200, noting that opening 210 is where a lineman, for example, would stand within aerial bucket 200 when bucket liner 900 is not used. Exemplary bucket liners 900 of the present disclosure have at least one tray 100 coupled thereto and/or formed or molded as part of bucket liner 900, as shown in FIG. 9C. In various embodiments, bucket liners 900 may comprise one, two, three, four, or more trays 100, coupled to bucket liner 900 and/or formed or molded as part of bucket liner 900, such as shown in a top view of an exemplary bucket liner 900 shown in FIG. 10, having a tray 100 located at each side 904 of a liner lip 902. As shown in FIGS. 9C and 10, tray 100 is located upon, or formed as part of, liner lip 902, in at least one embodiment. When bucket liner 900 is used, a lineman, for example, would stand within bucket opening 906 of bucket liner 900. FIG. 11 shows an exemplary aerial bucket hook 202 of the present disclosure, configured to retain tray 100 to aerial bucket 200 or bucket liner 900 in embodiments of the same that do not already have a tray 100, for example. In various embodiments, one or more sides 904 of bucket liner 900 can have one or more trays 100 coupled thereto and/or formed or molded as part of bucket liner 900. In at least one embodiment, bucket liner 900 comprises a tray 100 on each of three sides 904.

Figure 12:
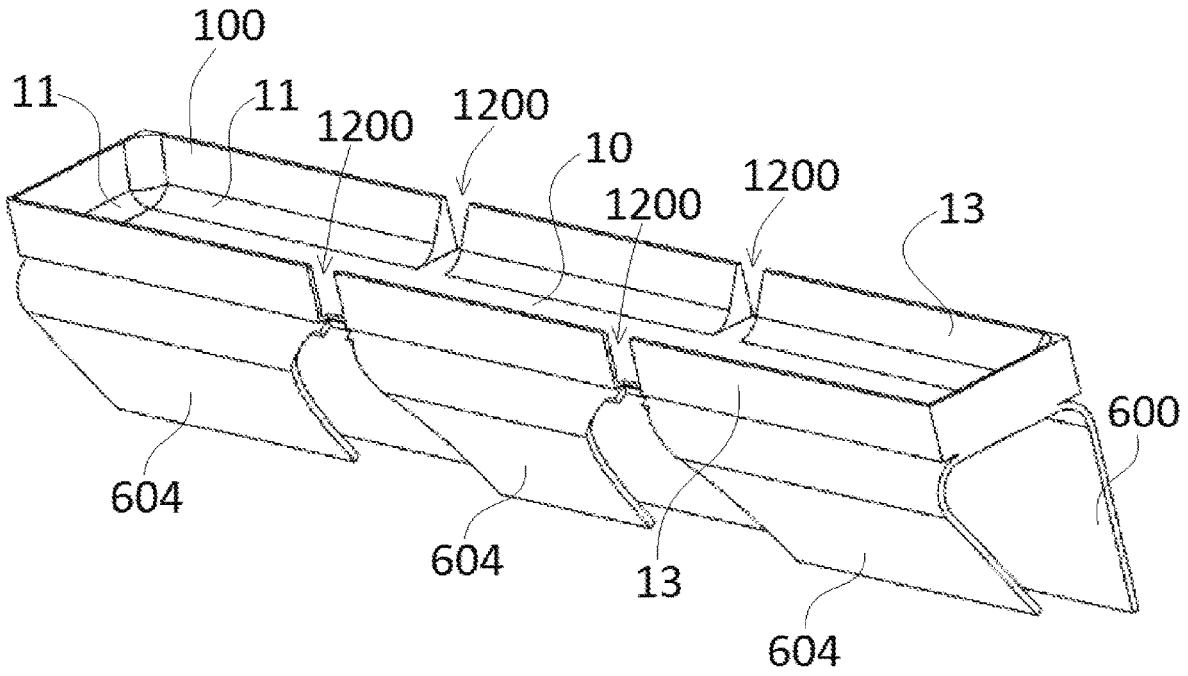
FIG. 12 shows a side perspective view of a tray having one or more tray notches defined therein, according to an exemplary embodiment of the present disclosure.

FIG. 12 shows an exemplary tray 100 of the present disclosure, having a number of the aforementioned features, such as an interior tray section 10, one or more ramps 11, and one or more sidewalls 13. In the tray embodiment shown in FIG. 12, and in other tray embodiments of the present disclosure, tray 100 further comprises a tool board 600 (which may be long, as shown in FIG. 7B, short, as shown in FIG. 12, and/or have one or more features thereon, as shown in FIG. 7C), and one or more outer lips 604 extending therefrom (extending from tray 100 or an upper portion 602, depending on the embodiment). Exemplary trays 100 of the present disclosure, as shown in FIG. 12, may further have one or more tray notches 1200 defined and/or formed therein, so to allow portions of one or more aerial bucket hooks 202, such as shown in FIG. 11 or otherwise, to fit within the one or more tray notches 1200 to facilitate securing said tray 100 to an aerial bucket 200 or to a bucket liner 900, as desired. As shown in FIG. 12, an exemplary tray 100 may define four tray notches 1200, and in other embodiments, more or less tray notches 1200 may be defined within trays 100. Tray notches 1200, as shown in FIG. 12, are formed within and/or adjacent to one or more sidewalls 13 of a tray 100, for example.

Figure 13:
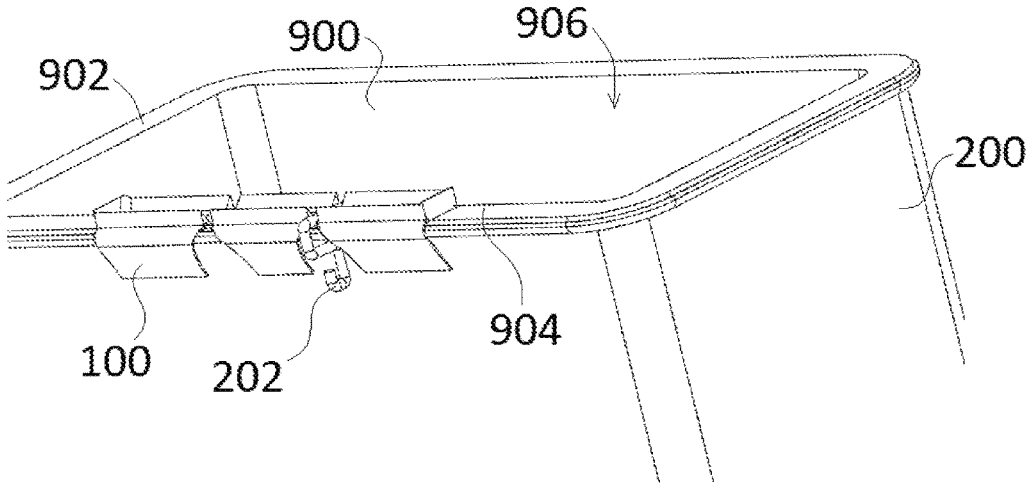
FIG. 13 shows a side perspective view of an aerial bucket liner inside an aerial bucket and a tray coupled thereto, according to an exemplary embodiment of the present disclosure.

FIG. 13 shows a perspective view of portions of an exemplary aerial bucket 200 of the present disclosure having a bucket liner 900 positioned therein. Bucket liner 900, as shown in FIG. 13, has a tray 100 positioned on one side 904 of bucket liner 900 on a liner lip 902, and is shown with one aerial bucket hook 202 used to secure tray 100 to bucket liner 900. Additional bucket hooks 202 may be used as desired.

Figure 14:
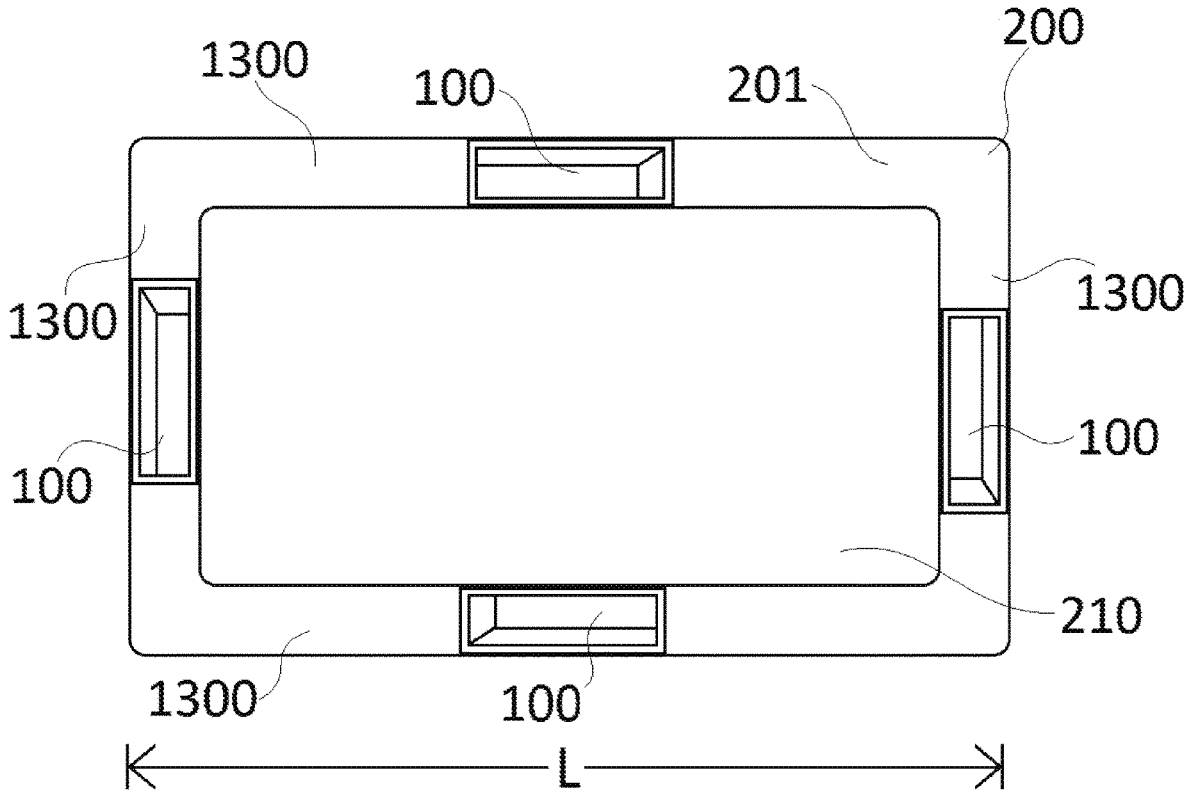
FIG. 14 shows a top-down view of an aerial bucket having one or more trays, according to an exemplary embodiment of the present disclosure.

FIG. 14 shows a top-down view of an exemplary aerial bucket 200 of the present disclosure, having at least one tray 100 (four trays 100 shown in the figure) coupled to and/or formed as part of aerial bucket 200. As shown in FIG. 14, one or more trays 100 can be positioned upon, or formed as part of, bucket lip 201 (such as at one or more sides 1300 of bucket lip 201), allowing a user to stand within bucket opening 210 and access the various trays 100.

Figure 15B:
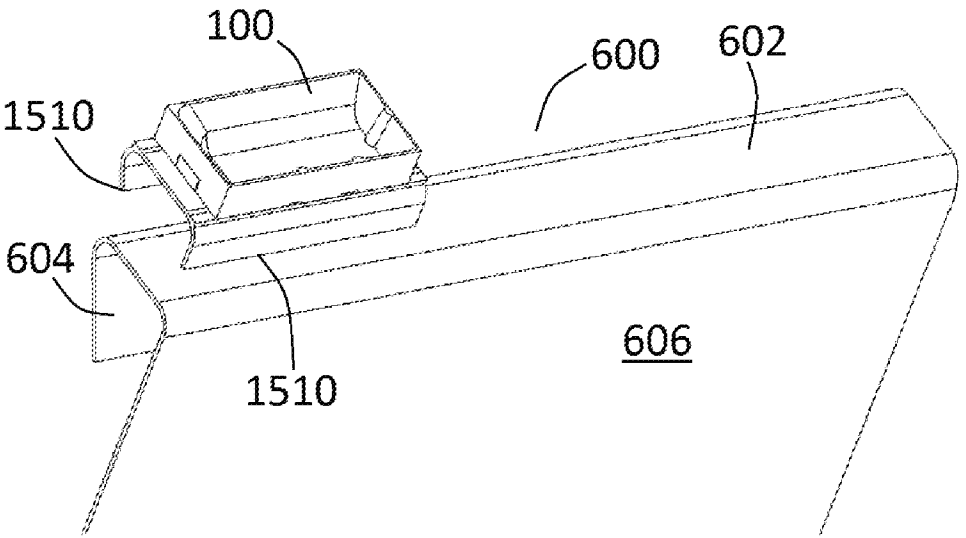
FIGS. 15A and 15B show perspective views of parts of trays configured for coupling to tool boards, according to exemplary embodiments of the present disclosure.
Figure 15A:
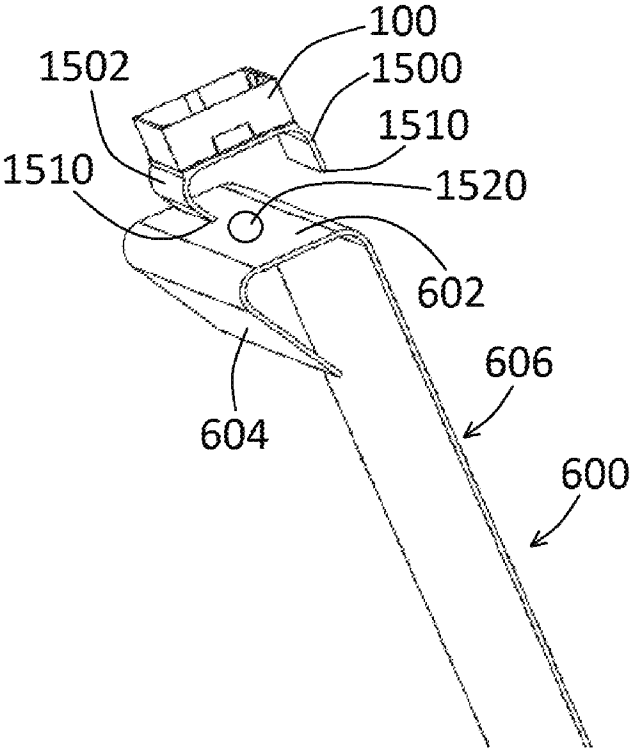

FIGS. 15A and 15B show an exemplary tray 100 of the present disclosure that also comprises a front flange 1500 and a back flange 1502. Front flange 1500 and back flange 1502, as shown in FIGS. 15A and 15B, extend downward past a relative underside of a tray 100 (such as shown in FIG. 2), wherein front flange 1500 has a profile/configuration generally corresponding with the portion of a tool board 600 between the upper portion 602 of tool board 600 to the front portion 606 of tool board, and wherein back flange 1502 has a profile/configuration generally corresponding with the portion of tool board 600 between the upper portion 602 and the outer lip 604 of tool board 600. As shown in FIG. 15A, back flange 1502 generally extends down and inward relative to tray 100, corresponding with the profile/configuration of outer lip 604 of tool board 600, which also generally extends down and inward toward the front portion 606 of tool board 600.

So to secure an embodiment of tray 100 upon a tool board 600, such as shown in FIGS. 15A and 15B, one or more of front flange 1500 and/or back flange 1502 can be relatively flexible so that one or both flange ends 1510 can extend below an upper portion 602 of tool board when tray 100 is positioned thereon. The overall configurations of front flange 1500 and/or back flange 1502 can cause tray 100 to become removably coupled to tray 600 without any additional securing mechanism, such as by using one or more aerial bucket hooks 202 as referenced herein. However, additional securing mechanisms may be desired, such as by using an adhesive 1520 positioned on tray 100 and/or tool board 600, could also be implemented. Adhesives 1520 can also be used to secure tray 100 directly to an aerial bucket 200 if desired. Furthermore, one or more fasteners 1675 and/or t-nuts 1700, as referenced below, can also be used to connect a tray 100 to a desired substrate.

Figure 16A:
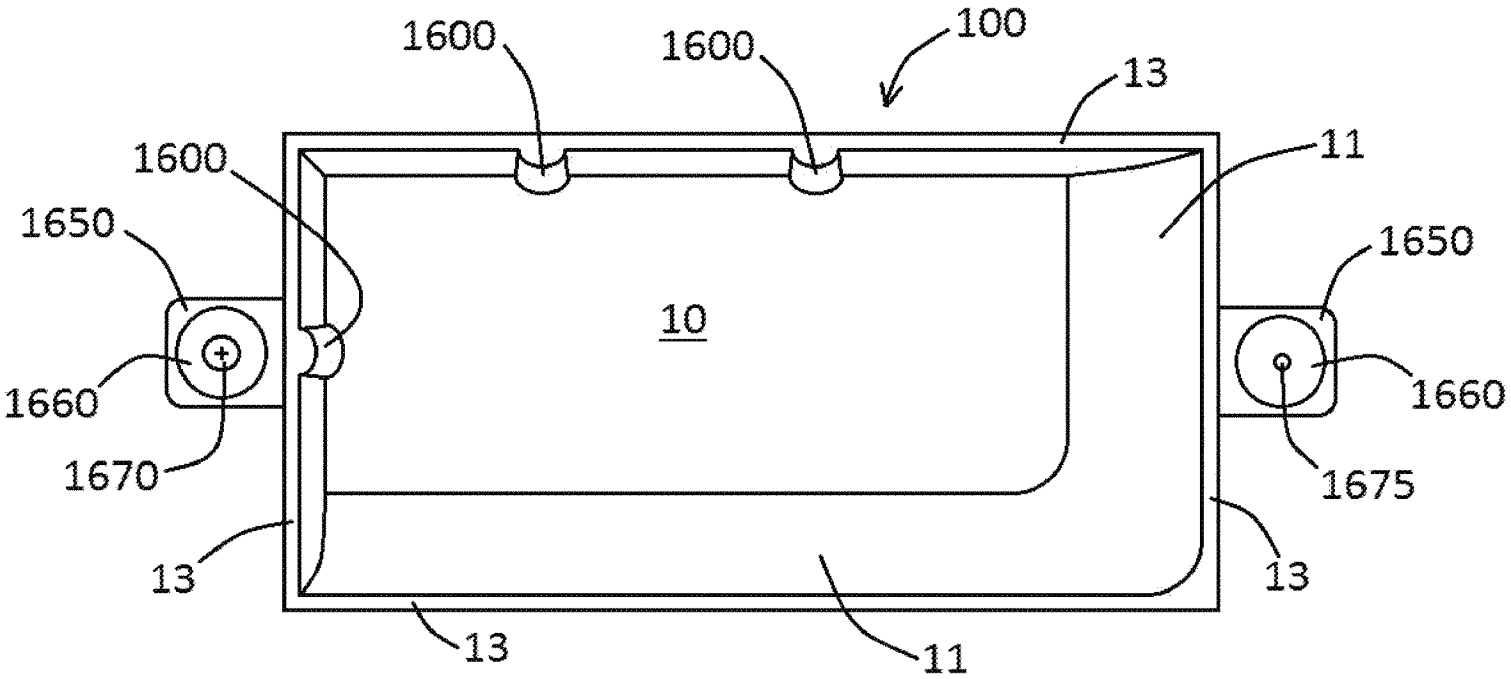
FIG. 16A shows a top view of a tray, according to an exemplary embodiment of the present disclosure.
Figure 16B:
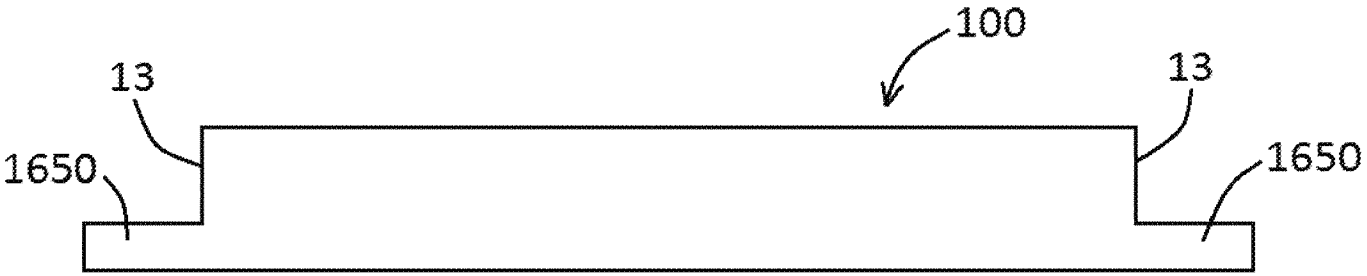
FIG. 16B shows a side view of a tray, according to an exemplary embodiment of the present disclosure.

FIG. 16 shows a top view of an exemplary tray 100 of the present disclosure having a ramp 11 extending inside tray 100 along two adjacent sides. Extending from at least one side 13, such as extending from two opposing sides 13 as shown in FIG. 16, exemplary trays 100 may comprise one or more extension flanges 1650 extending therefrom, with, in various embodiments, the relative bottoms of said flanges 1650 aligning with the relative bottom of tray 100, as depicted in the side view of the tray 100 of FIG. 16A shown in FIG. 16B. Extension flanges, as shown in FIG. 16A, may have an indented portion 1660 defined therein, so that, for example, when a fastener 1670 (such as a screw, nail, bolt, rivet, or other mechanical fastener known or developed in the art) is positioned within an aperture 1675 defined within extension flange 1650 so to receive fastener 1670 therethrough, a relative top part of fastener 1670 may be flush with a relative top of flange 1650. In various embodiments, fasteners 1670 can extend through tray 100 (through aperture 1675) and into an aerial bucket 200, tool board 600, aerial bucket liner 900, or another substrate so to couple tray 100 to the same. As noted above, adhesive 1520 can also be used to attach tray 100 to the desired substrate (such as aerial bucket 200 and/or tool board 600, for example), along with the use of one or more fasteners 1670.

In addition, and as shown in FIG. 16A, exemplary tray embodiments may include one or more inner protrusions 1600 extending most or all of a length of a side 13 from the relative top to the inside 11 of tray 100, so to provide for additional structural integrity of the various sides 13 of tray 1000 having said inner protrusions 1600. Prior figures herein also show said inner protrusions, but unlabeled.

Figure 17:
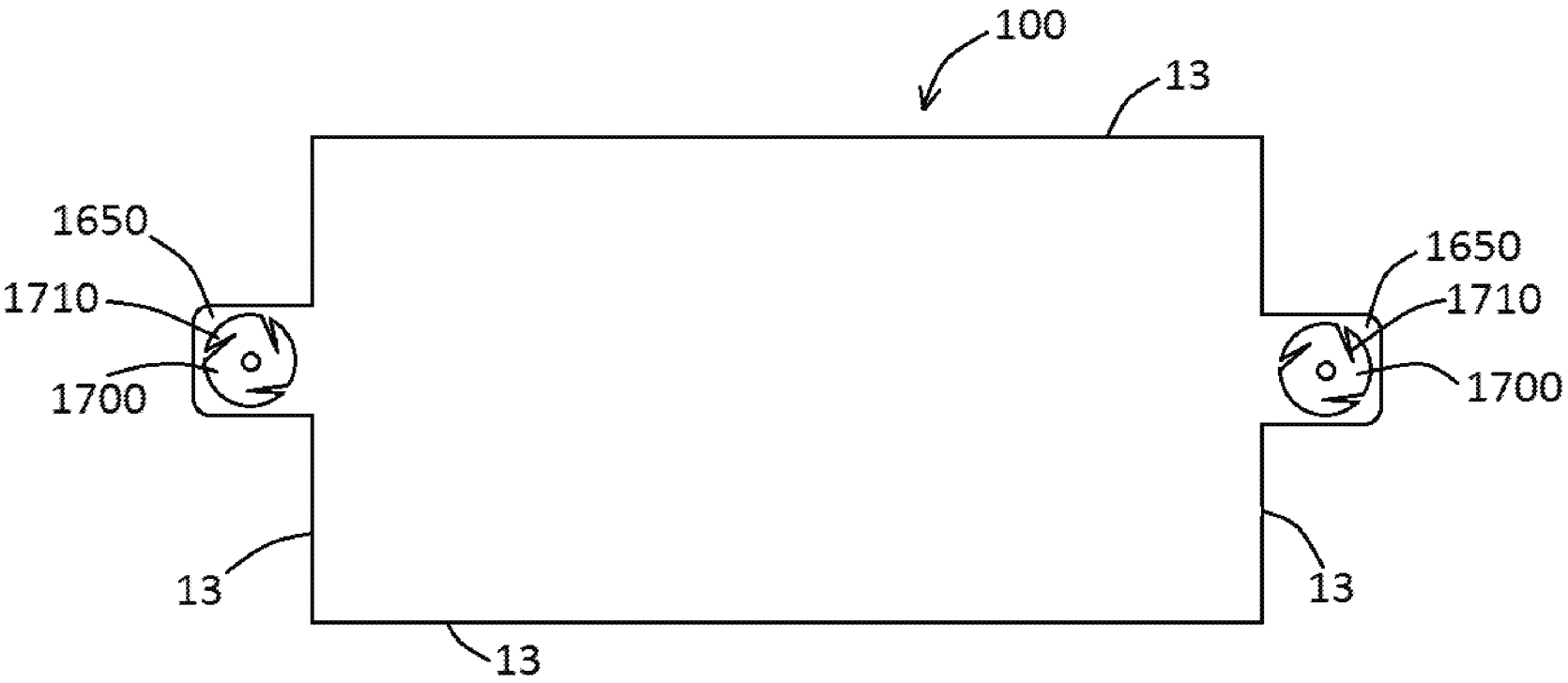
FIG. 17 shows a bottom view of a tray, according to an exemplary embodiment of the present disclosure.

FIG. 17 shows an underside of tray 100 along with exemplary t-nuts 1700 that may be used in connection with a fastener 1670 of the present disclosure. T-nuts 1700 are positioned relative to tray 100 in FIG. 17, but in actual use, for example, t-nuts 1700 (configured to receive part of fastener 1670 and retain the same therein) would be positioned underneath a bucket lip 201 of an aerial bucket 200, underneath an upper portion 602 of a tool board 600, etc., so that the fastener 1670 extends through tray 100 and through aerial bucket 200 or tool board 600, where a t-nut 1700 would be used to secure fastener 1670 and therefore tray 100 in place. T-nuts 1700 may be referred to as locking nuts, for example, such as those having one or more gripping tabs 1710, as shown in FIG. 17, for insertion into the substrate or tray 100, as applicable.

Figure 18A:
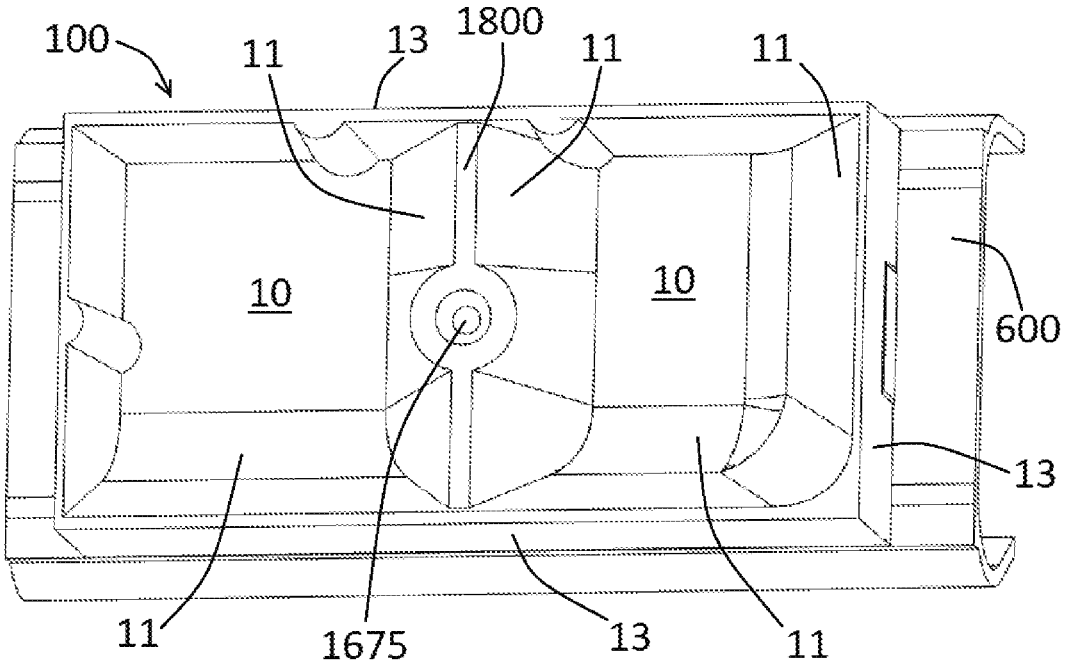
FIGS. 18A and 18B shows perspective views of trays, according to exemplary embodiments of the present disclosure.
Figure 18B:
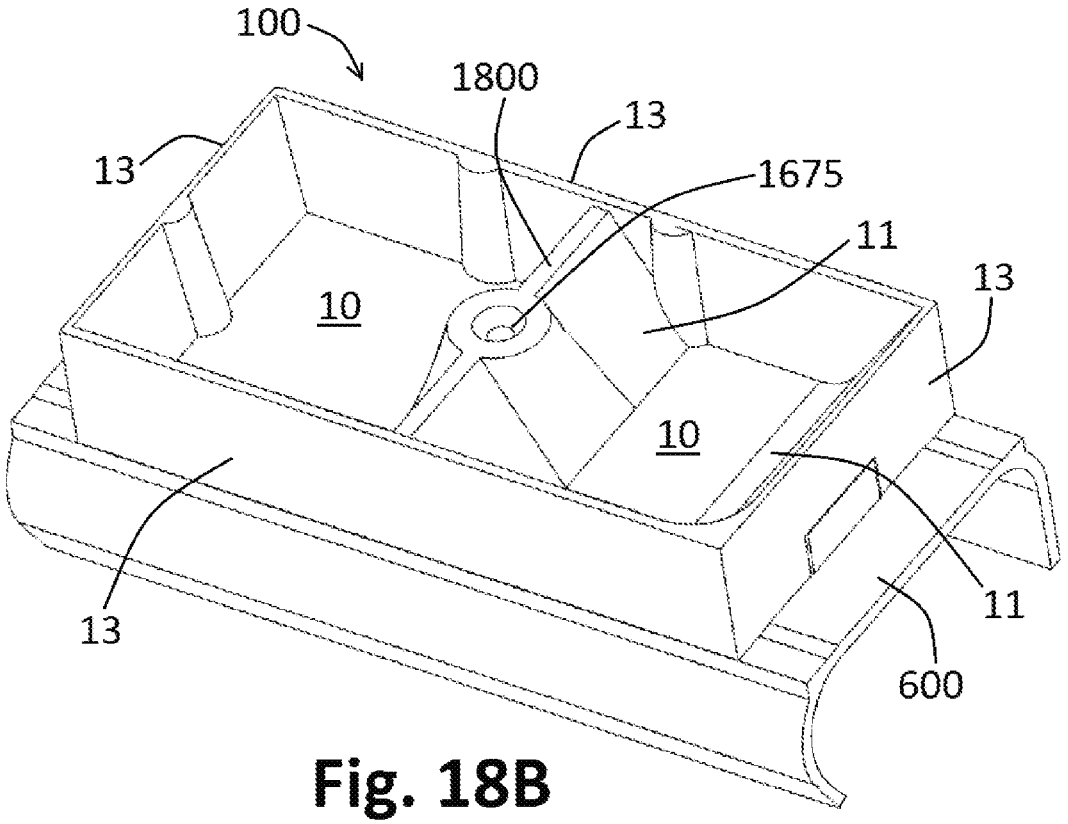

FIG. 18A shows a top perspective view, and FIG. 18B shows an angled perspective view, of an additional tray 100 embodiment of the present disclosure. As shown in FIGS. 18A and 18B, tray 100 comprises several elements of other trays 100 referenced herein, but also includes an internal divider 1800 extending from one side 13 to an opposing side 13 (such as across the shorter length, as shown in the figures, or across the longer length, as desired). In various embodiments, one or more ramps 11 can extend along divider 1800, such as readily depicted in FIG. 18A, to provide additional flexibility to the user regarding accessibility of fasteners within tray 100 and the ability to separate different types of fasteners on either side of divider 1800.

Furthermore, and as shown in FIGS. 18A and 18B, one or more apertures 1675 can be defined within internal divider 1800 so to receive a fastener 1670, such as shown in FIG. 16A and referenced herein. This configuration provides the user with the ability to attach tray 100 to aerial bucket 200, tool board 600, bucket liner 900, and/or another substrate, using one or more fasteners 1670 while, for example, an adhesive 1520 has an opportunity to set/cure/harden.

Another exemplary system 150 of the present disclosure comprises one or more of a tray 100, aerial bucket 200, aerial bucket liner 900, tool board 600, and/or a bucket hook 202, as shown in the various figures herein. Furthermore, and as generally referenced herein, trays 100 of the present disclosure can be coupled to, or formed part of, one or more of an aerial bucket 200, tool board 600, aerial bucket liner 900, or another desired substrate. In addition, any number of trays 100 having any number of lengths L (as shown in FIG. 14) can be coupled to, or formed as part of, various aerial bucket 200, tool board 600, and/or aerial bucket liner 900 embodiments. For example, and in at least one embodiment, a tray 100 having a length of at least half of a length of an aerial bucket 200, tool board 600, or aerial bucket liner 900, can be coupled to or formed part of the same. In various embodiments, trays 100 can have a length L of 3", 4", 6", 8", 10", 12", 15", 16", longer, shorter, or somewhere in between.

In various embodiments, tray 100, dowel 16, stanchion 17, and/or other components discussed herein may be constructed of one or more types of molded plastic or other non-electrically conductive materials common in the art. In other alternative embodiments, tray 100 and/or other components may be made of wood, plastic, fiberglass, carbon fiber, aluminum, metal alloys, or a combination of materials common in the art.

While various embodiments of tool trays and systems, devices, and methods to use the same have been described in considerable detail herein, the embodiments are merely offered as non-limiting examples. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A tray, comprising:

an interior tray section configured to receive one or more items, the interior tray section at least partially surrounded by at least one sidewall having a height;

a first ramp portion in communication with the interior tray section, the first ramp portion defining a sloping surface that extends from the interior tray section to a top of the at least one sidewall; and at least one notch defined within the at least one side wall, the at least one notch configured to receive at least part of at least one aerial bucket hook therein;

wherein the tray is configured to be secured to an aerial bucket or an aerial bucket liner.

2. The tray of claim 1, wherein when the tray is positioned upon a portion of the aerial bucket or the aerial bucket liner and wherein when the at least one aerial bucket hook is positioned within the at least one notch, the tray is secured to the aerial bucket or the aerial bucket liner.

3. The tray of claim 2, forming part of a kit, the kit further comprising:

the at least one aerial bucket hook.

4. The tray of claim 1, wherein the at least one sidewall comprises at least two sidewalls.

5. The tray of claim 1, wherein the at least one notch comprises at least two notches.

6. The tray of claim 5, wherein when the tray is positioned upon a portion of the aerial bucket or the aerial bucket liner and wherein when the at least one aerial bucket hook is positioned within the at least two notches, the tray is secured to the aerial bucket or the aerial bucket liner using the at least one aerial bucket hook.

7. The tray of claim 6, forming part of a kit, the kit further comprising:

the at least one aerial bucket hook.

8. The tray of claim 1, further comprising a front flange and a back flange extending from the tray, the front flange and the back flange configured to secure the tray to a tool board when the tray is positioned upon the tool board.

9. The tray of claim 1, further comprising at least one extension flange having an aperture defined therethrough, whereby the tray can be secured to a tool board using a fastener positioned within the aperture.

10. The tray of claim 1, further comprising a second ramp portion in communication with the interior tray section, the second ramp portion defining a second sloping surface that extends from the interior tray section to the top of the at least one sidewall.

11. The tray of claim 10, wherein the second ramp portion is located opposite the first ramp portion.

12. The tray of claim 10, wherein the second ramp portion is located adjacent to the first ramp portion.

13. The tray of claim 1, wherein the tray is formed of a non-conductive material.

14. A kit, comprising:

a tray configured to be secured to an aerial bucket or an aerial bucket liner, the tray comprising:

an interior tray section configured to receive one or more items, the interior tray section at least partially surrounded by at least one sidewall having a height;

a first ramp portion in communication with the interior tray section, the first ramp portion defining a sloping surface that extends from the interior tray section to a top of the at least one sidewall; and at least one notch defined within the at least one side wall, the at least one notch configured to receive at least part of at least one aerial bucket hook therein; and the at least one aerial bucket hook;

wherein when the tray is positioned upon a portion of the aerial bucket or the aerial bucket liner and wherein when the at least one aerial bucket hook is positioned within the at least one notch, the tray is secured to the aerial bucket or the aerial bucket liner.

15. The kit of claim 14, further comprising a second ramp portion in communication with the interior tray section, the second ramp portion defining a second sloping surface that extends from the interior tray section to the top of the at least one sidewall.

16. The kit of claim 15, wherein the second ramp portion is located opposite the first ramp portion.

17. The kit of claim 15, wherein the second ramp portion is located adjacent to the first ramp portion.

18. A kit, comprising:

a tray configured to be secured to an aerial bucket or an aerial bucket liner, the tray comprising:

an interior tray section at least partially surrounded by at least one sidewall;

a first ramp portion in communication with the interior tray section, the first ramp portion defining a sloping surface that extends from the interior tray section to a top of the at least one sidewall; and at least one notch defined within the at least one side wall; and the at least one aerial bucket hook.

19. The kit of claim 18, wherein the at least one notch comprises at least two notches, and wherein the at least one aerial bucket hook comprises two aerial bucket hooks.

20. The kit of claim 19, wherein when the tray is positioned upon a portion of the aerial bucket or the aerial bucket liner and wherein when the at least two aerial bucket hooks are positioned within the at least two notches, the tray is secured to the aerial bucket or the aerial bucket liner by way of the at least two aerial bucket hooks.

* * * * *